US009631372B1

(12) United States Patent
Bilge

(10) Patent No.: US 9,631,372 B1
(45) Date of Patent: Apr. 25, 2017

(54) WALL PANELS TO BE MOUNTED TO A WALL STRUCTURE

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 14/667,297

(22) Filed: Mar. 24, 2015

(51) Int. Cl.
*E04F 13/072* (2006.01)
*E04F 13/08* (2006.01)

(52) U.S. Cl.
CPC ..... *E04F 13/072* (2013.01); *E04F 13/0871* (2013.01); *E04F 2203/02* (2013.01)

(58) Field of Classification Search
CPC . E04F 13/072; E04F 13/0871; E04F 2203/02; A63H 33/04; A63H 33/044; A63H 33/06; A63H 33/08; A63H 33/10
USPC ..... 52/169.12, 311.1, 314, 578; 446/108, 446/111, 114, 115
See application file for complete search history.

(56) References Cited

U.S. PATENT DOCUMENTS 1,655,406 A 1/1928 Bennett
1,726,500 A 8/1929 Norris
1,833,174 A 11/1931 Norris
1,940,968 A 12/1933 Ohlis
2,059,483 A 11/1936 Parsons
2,066,205 A 12/1936 Keating
2,073,278 A 3/1937 Hohl
2,082,241 A 6/1937 Bennett
2,513,711 A 7/1950 Cain
2,607,971 A * 8/1952 Bedford, Jr. ..... E04F 13/0842 24/458
2,789,321 A 4/1957 Adams
2,803,321 A 8/1957 Fox-Williams
3,021,915 A 2/1962 Kemp
3,216,538 A * 11/1965 Miller ..... E04F 10/08 29/432
3,263,388 A 8/1966 Bogert
3,521,419 A 7/1970 Fornells
3,530,633 A * 9/1970 Scott ..... E04B 1/6145 52/235
3,605,368 A 9/1971 Lalouche
3,665,666 A 5/1972 Delcroix
3,671,061 A 6/1972 Dawdy
(Continued)

FOREIGN PATENT DOCUMENTS

DE 3732534 A1 4/1989
DE 3732535 A1 4/1989
(Continued)

OTHER PUBLICATIONS

Bamco Inc., G500 Wall System.

*Primary Examiner* — Brian Glessner
*Assistant Examiner* — Adam Barlow
(74) *Attorney, Agent, or Firm* — Richard M. Goldberg

(57) ABSTRACT

A wall panel adapted to engage with an extrusion that is secured to an existing wall structure, in order to mount the wall panel in covering relation to the existing wall structure, includes a main wall panel section, the main wall panel section presenting a three-dimensional shape in cross-section, the main wall panel section including a plurality of sections extending at different angles relative to each other; and at least two bent end sections extending at an angle from different edges of the main wall panel section, each bent end section adapted to engage the extrusion in order to mount the wall panel in covering relation to the existing wall structure.

9 Claims, 33 Drawing Sheets

(56) References Cited

U.S. PATENT DOCUMENTS 3,688,460 A 9/1972 Van Loghem
3,858,377 A 1/1975 Browne et al.
3,868,802 A 3/1975 Schubach
3,994,471 A * 11/1976 Turolla ..... E04G 17/00 249/193
4,001,974 A * 1/1977 Wright ..... E06B 7/2312 428/122
4,067,155 A 1/1978 Ruff
4,184,297 A * 1/1980 Casamayor ..... E06B 3/5871 52/202
4,300,323 A 11/1981 Meechan
4,332,119 A 6/1982 Toews
4,344,267 A 8/1982 Sukolics
4,385,850 A 5/1983 Bobath
4,452,020 A * 6/1984 Werner ..... E06B 3/28 49/62
4,452,029 A 6/1984 Sukolics
4,557,091 A * 12/1985 Auer ..... E04B 2/72 52/282.2
4,573,300 A 3/1986 Bezner
4,640,064 A 2/1987 Goodworth, II
4,667,579 A 5/1987 Daw
RE32,509 E * 9/1987 Werner ..... E06B 3/28 52/202
4,696,142 A 9/1987 Meiyal et al.
4,703,603 A * 11/1987 Hills ..... F16B 5/0028 52/582.1
4,736,563 A 4/1988 Bilhorn
4,777,774 A * 10/1988 Smalley, III ..... E04B 2/72 52/282.3
4,829,740 A 5/1989 Hutchison
4,833,839 A 5/1989 Kurose
4,833,858 A 5/1989 Hutchison
4,936,065 A 6/1990 Hutchinson
4,965,976 A 10/1990 Riddle
5,005,315 A * 4/1991 Jackson, Jr. ..... E04B 2/827 49/127
5,067,286 A 11/1991 Richer
5,076,035 A 12/1991 Wright
5,155,952 A 10/1992 Herwegh
5,226,755 A * 7/1993 Tweedt ..... E04B 2/72 248/300
5,263,292 A 11/1993 Holland et al.
5,309,686 A 5/1994 Underwood
5,353,571 A 10/1994 Berdan
5,365,713 A 11/1994 Nicholas
5,426,899 A * 6/1995 Jones ..... E04B 7/14 135/908
5,579,624 A 12/1996 Aeberhard
5,611,185 A 3/1997 Wilz
5,644,878 A 7/1997 Wehrmann
5,809,729 A 9/1998 Mitchell
5,993,321 A 11/1999 Recknagel
5,996,301 A 12/1999 Conterno
6,101,777 A 8/2000 Bodine et al.
6,164,024 A 12/2000 Konstantin
6,170,212 B1 1/2001 Suchyna
6,205,733 B1 3/2001 LaLonde
6,289,645 B1 * 9/2001 Schmid ..... E04B 1/6806 403/269
6,330,772 B1 12/2001 Mitchell et al.
6,430,885 B1 8/2002 Ito
6,525,270 B1 * 2/2003 Connor ..... H01R 4/186 174/84 C
6,536,175 B2 3/2003 Conterno
6,647,680 B2 11/2003 Daly
6,745,527 B1 6/2004 Sherman et al.
6,751,916 B1 6/2004 Ritzer et al.
6,892,500 B2 5/2005 Zabrowski
7,210,273 B2 5/2007 Zahner, II
7,472,521 B2 1/2009 Bilge
7,562,504 B2 7/2009 Herbst
7,621,084 B2 11/2009 Bilge
7,627,983 B1 12/2009 Deutsch-Aboulmahassine et al.
7,752,818 B1 7/2010 Roegge et al.
7,802,408 B2 * 9/2010 Asbury ..... F16B 5/02 403/21
7,895,802 B2 3/2011 Kurz
8,127,507 B1 3/2012 Bilge
8,136,321 B1 3/2012 Bauman
8,166,716 B2 5/2012 Macdonald et al.
8,225,572 B2 7/2012 Wallace
8,256,181 B2 9/2012 Voegele, Jr. et al.
8,266,863 B2 * 9/2012 Knauseder ..... E04F 15/02 403/293
8,307,607 B2 11/2012 Conterno
8,316,609 B2 11/2012 Ben-Zvi
8,347,569 B1 1/2013 McIntyre et al.
8,640,402 B1 2/2014 Bilge
8,683,761 B2 4/2014 Danning
8,739,483 B1 6/2014 Bilge
8,793,941 B2 8/2014 Bosler
8,833,015 B2 9/2014 Bilge
8,925,271 B1 1/2015 Bilge
8,966,849 B1 3/2015 Bilge
9,227,764 B2 1/2016 Martino
2001/0022058 A1 9/2001 Conterno
2002/0035811 A1 3/2002 Heuel
2002/0152704 A1 10/2002 Thompson et al.
2002/0178684 A1 12/2002 Barnett
2004/0134143 A1 7/2004 Boyer
2005/0060950 A1 3/2005 Hauschildt
2009/0049770 A1 2/2009 Konstantin
2009/0241444 A1 10/2009 Griffiths
2009/0241451 A1 10/2009 Griffiths
2010/0083599 A1 4/2010 Meulemans
2010/0109567 A1 5/2010 Deurenberg et al.
2010/0130094 A1 * 5/2010 Michalk ..... A63H 33/062 446/111
2010/0220469 A1 9/2010 Ivey
2012/0110938 A1 5/2012 DesJardins
2012/0273633 A1 11/2012 Henriott
2014/0202112 A1 7/2014 Bilge
2014/0202113 A1 7/2014 Bilge
2014/0223850 A1 8/2014 Bilge
2015/0288320 A1 10/2015 Stearns
2016/0083964 A1 3/2016 Martino

FOREIGN PATENT DOCUMENTS

EP 2166169 A1 3/2010
FR 3000872 A1 7/2014
GB 2135355 A 8/1984
JP 8-189176 A 7/1997

* cited by examiner

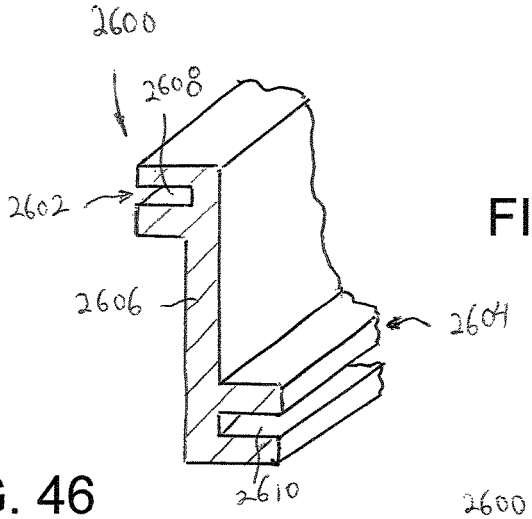
FIG. 45
FIG. 46
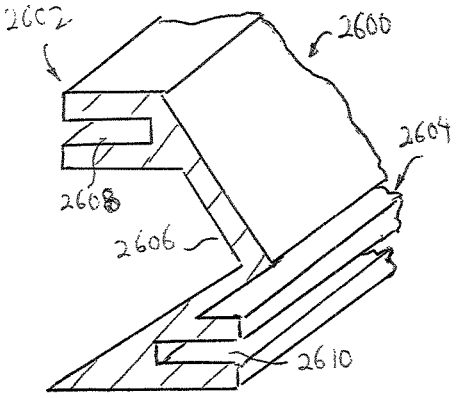
FIG. 47
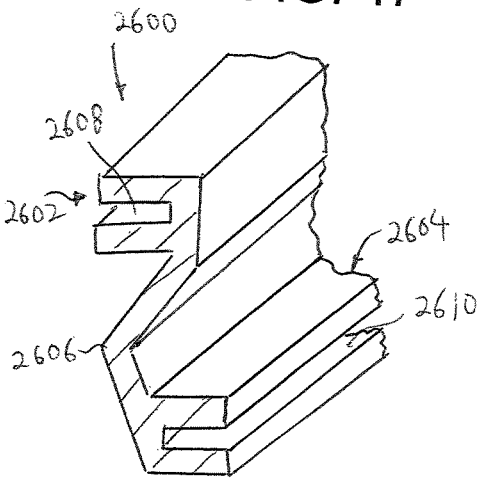
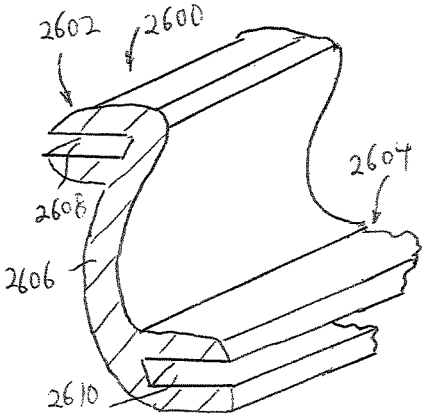
FIG. 48
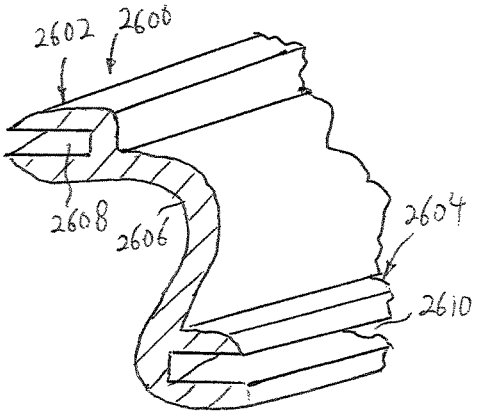
FIG. 49

WALL PANELS TO BE MOUNTED TO A WALL STRUCTURE

BACKGROUND OF THE INVENTION

The present invention relates generally to a wall system, and more particularly, to wall panels to be mounted over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes these problems is disclosed in U.S. Pat. Nos. 8,739,483, 8,925,271 and 8,966,849 to the same inventor herein, the entire disclosures of which are incorporated herein by reference. In these patents, there is disclosed two spaced apart wall panels that snap into place such that adjacent bent end sections of adjacent wall panels are secured with a spacing therebetween to a common extrusion that is secured to an existing wall. In order to cover the gap between the adjacent wall panels, a plug or other element can be inserted between the wall panels to provide an aesthetic appearance and can be sealed therein as well.

However, the plug or other element inserted between the wall panels, according to the above patents, is limited in its construction and appearance, may provide a complicated construction for securement and/or does not always provide a positive securement in the gap.

SUMMARY OF THE INVENTION

Accordingly, it is an object of the present invention to provide a wall panel that overcomes the aforementioned problems.

It is an object of the present invention to provide wall panels that are easy to assemble with an existing wall structure.

It is another object of the present invention to provide a wall panel formed by a plurality of sections connected together by at least one connecting element.

It is still another object of the present invention to provide a wall panel having connecting elements which connect together the sections used to form each wall panel in order to provide a three-dimensional and/or other aesthetic appearance.

It is yet another object of the present invention to provide a wall panel in which the connecting elements used to form each wall panel further raise the sections of the wall panel relative to each other to provide an enhanced three-dimensional and/or other aesthetic appearance.

It is a further object of the present invention to provide a wall system that is easy and economical to manufacture and use.

In accordance with an aspect of the present invention, a wall panel adapted to engage with an extrusion that is secured to an existing wall structure, in order to mount the wall panel in covering relation to the existing wall structure, includes a main wall panel section, the main wall panel section presenting a three-dimensional shape in cross-section; and at least two bent end sections extending at an angle from different edges of the main wall panel section, each bent end section adapted to engage the extrusion in order to mount the wall panel in covering relation to the existing wall structure.

The main wall panel section is comprised of a plurality of sections extending at different angles relative to each other. Preferably, at least two of the sections are discrete sections, and further including at least one connecting element for connecting together the plurality of separate sections of each wall panel.

In one embodiment each connecting element has a substantially H-shaped cross-section with an upper plate, a lower plate and a central web plate which connects together the upper plate and lower plate in spaced apart relation so as to define a first capture space between the upper plate and lower plate on one side of the central web plate for receiving an edge of one section of the main wall panel section and a second capture space between the upper plate and lower plate on an opposite side of the central web plate for receiving an edge of another adjacent section of the main wall panel section.

At least one of the upper plate and lower plate can have an outer curvature. The upper plate can also provide an enhanced three-dimensional effect. Preferably, the first and second capture spaces extend at an angle relative to each other.

In another embodiment, each connecting element includes a central web wall, a first bifurcated section at one end of the central web wall and positioned on one side of the central web wall, the first bifurcated section having a first capture space for receiving an edge of one section of the main wall panel section, and a second bifurcated section at an opposite end of the central web wall and positioned on an opposite side of the central web wall, the second bifurcated section having a second capture space for receiving an edge of another section of the main wall panel section.

The central web wall has a cross-sectional shape which is one of linear, V-shaped, and curved. The central web wall can also taper from one end another end thereof.

Also, the at least one connecting element can have a color different from a color of the main wall panel section.

In another embodiment, at least two adjacent sections are discrete sections, with each adjacent section including a bent strip for seating flush against the bent strip of the adjacent section, and further including at least one connecting element for connecting together the flush seated bent strips to each other. In such case, each connecting element includes one of the following: a screw, a rivet, and a clamp. Each bent strip includes a plurality of openings through which the at least one connecting element extends.

The main wall panel sections have a shape selected from the following shapes:

a trapezoidal shape in cross-section;

a rectangular in cross-section;

a mushroom shape in cress-section;

a shape in cross-section defined by outwardly inclined surfaces that meet at a central, upper concave surface;

a roof like shape in cross-section;

a shape in cross-section defined by outwardly inclined surfaces that meet at a central, wave-like surface;

a pyramid shape;

trapezoidal side walls connected at shorter sides of each trapezoidal side wall to a rectangular center section; and a plurality of connected arcuate sections.

In another embodiment, the main wall panel section is formed from a unitary blank having adjacent sections thereof separated by a small V-shaped gap to enable bending of the sections relative to each other to present the three-dimensional shape in cross-section, with adjacent edges of the adjacent sections being secured together by an adhesive member.

There can also be at least one opening in the main wall panel section.

Further, an outer surface of the main wall panel section can include at least one depression for creating the three-dimensional shape.

Also, the main panel section can extend either inwardly of the bent end sections or outwardly of the bent end sections.

In addition, there is at least one of the following secured to the wall panel: a planter box, at least one lighting element, at least one candle element, at least one picture element and at least one electronic element.

The above and other features of the invention will become readily apparent from the following detailed description thereof which is to be read in connection with the accompanying drawings.

BRIEF DESCRIPTION OF THE DRAWINGS

FIG. 45 is a perspective, cut-away view showing a fourth modified connecting element which connects together sections of a wall panel;

FIG. 46 is a perspective, cut-away view showing a fifth modified connecting element which connects together sections of a wall panel;

FIG. 47 is a perspective, cut-away view showing a sixth modified connecting element which connects together sections of a wall panel;

FIG. 48 is a perspective, cut-away view showing a seventh modified connecting element which connects together sections of a wall panel;

FIG. 49 is a perspective, cut-away view showing an eighth modified connecting element which connects together sections of a wall panel;

DETAILED DESCRIPTION

Figure 1:
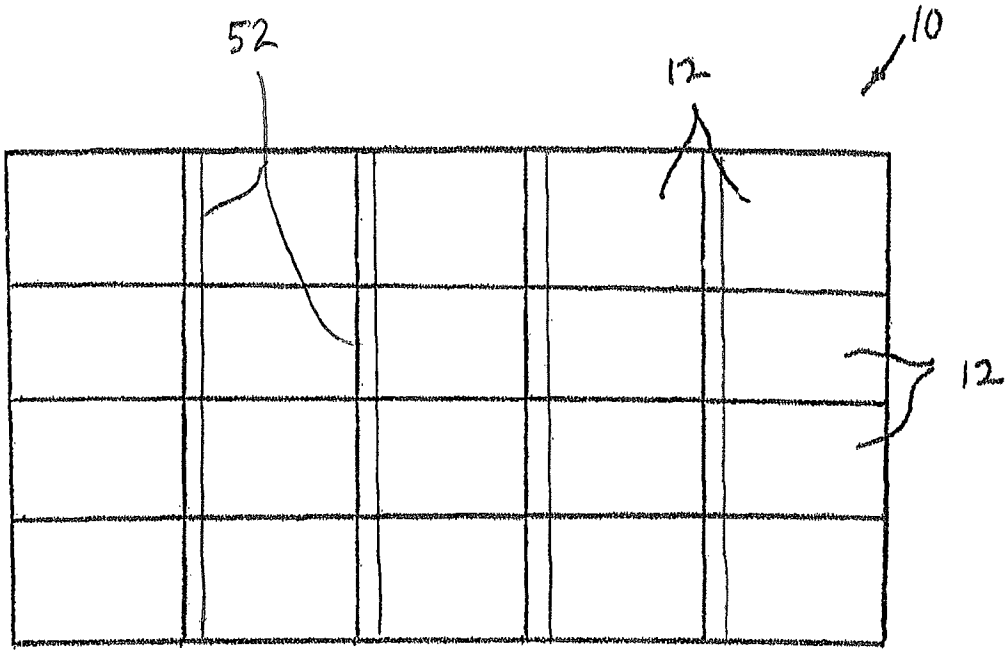
FIG. 1 is an elevational view of a plurality of wall panels mounted to an existing wall structure.
Figure 2:
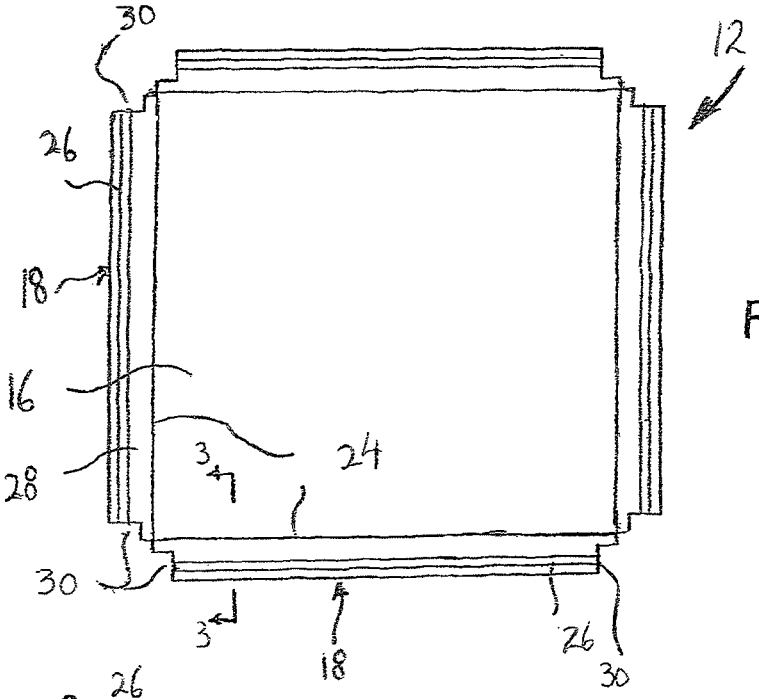
FIG. 2 is a bottom plan view of a blank for forming the wall panel of FIG. 2.
Figure 3:
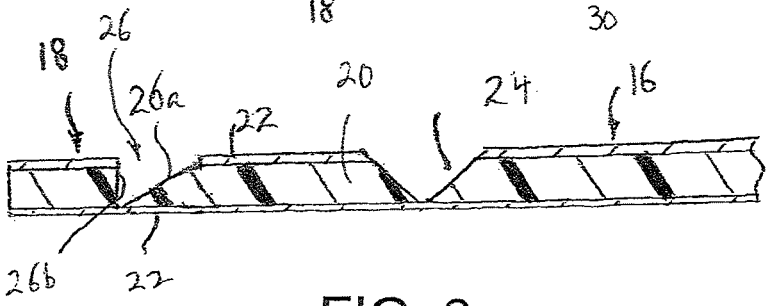
FIG. 3 is a cross-sectional view of the blank of FIG. 3, taken along line 3-3 thereof.

Referring to the drawings in detail, and initially to FIGS. 1-4 thereof, there is shown a system 10 according to the present invention for easily mounting primary wall panels 12 over an existing wall structure 14. Wall structure 14 preferably includes any planar wall. Each primary wall panel 12 includes a rectangular shaped, planar main panel section 16 and at least two bent end sections 18 bent at a right angle in the same direction at edges of main panel section 16. Main panel section 16, however, need not be planar, and in fact, can have different shapes, such as a wave shape, etc. to provide different aesthetic appearances. Preferably, there are four bent end sections 18 at each edge of main panel section 16 which form an L-shaped cross sectional shape thereat. However, the invention is not limited thereby and primary wall panels 12 can be formed with two, three or more bent end sections 18. Primary wall panels 12 are formed preferably by, but not limited to, a polyethylene core 20 with an aluminum wall 22 covering opposite sides thereof, as shown in FIG. 3. However, for the sake of simplicity in the drawings, all of the drawings except for FIG. 3 show primary wall panels 12 formed of only a single material.

Figure 4:
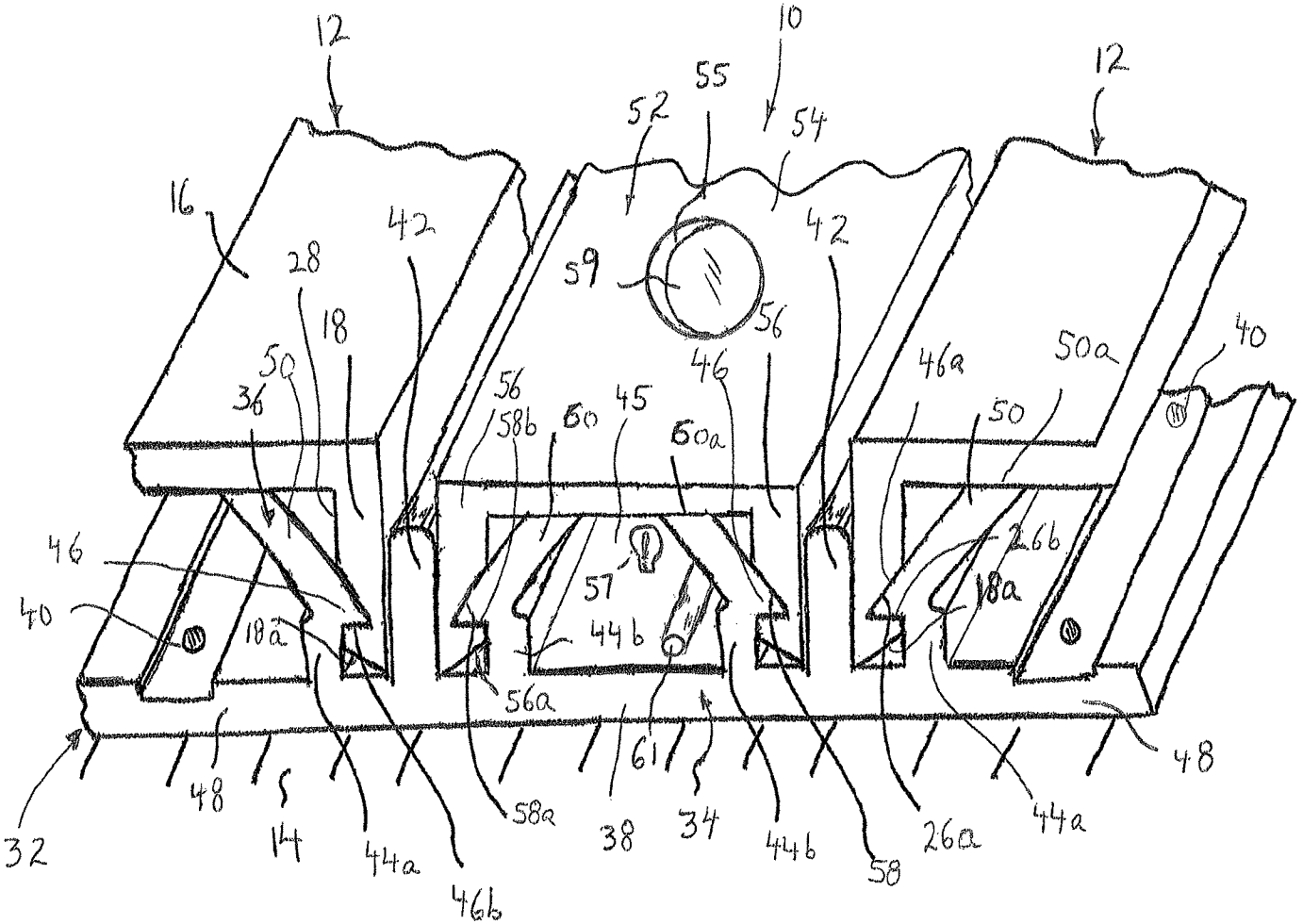
FIG. 4 is a perspective view of a system for mounting primary wall panels and secondary plug wall panels over an existing wall structure according to the present invention.

As shown in FIGS. 2 and 3, each primary wall panel 12 is preferably formed from a planar blank, which can be stamped from or cut from a larger sheet of the respective material. Specifically, each planar blank is formed by planar main panel section 16 which is preferably, but not limited to, a square shape with all sides being equal. There are four bent end sections 18, each formed as one unitary piece at a respective side edge of planar main panel section 16, and coplanar therewith. A V-shaped cut-out 24 extends through one thin aluminum wall 22 and polyethylene core 20 at the connecting edge of each bend end section 18 to the side edge of planar main panel section 16, as best shown in FIG. 3. This permits each bent end section 18 to be bent along its respective V-shaped cut-out 24 at a right angle to planar main panel section 16 in the manner shown, for example, in FIG. 4. Each bent end section 18 further includes a cut-out recess 26 extending the length of the inner surface 28 thereof and spaced slightly away from main panel section 16. Each cut-out recess 26 preferably has an acute angle, nose-shaped configuration in cross-section, as shown in FIGS. 3 and 4, although the present invention is not limited thereby. As a result, cut-out recess 26 effectively forms a notch in the inner surface 28 of bent end section 18. Thus, each cut-out recess 26 has an inclined surface 26*a* that extends toward the distal end of the bent end section 18 at the inner surface 28 thereof, and terminates at a holding surface 26*b* that extends parallel to main panel section 16. Cut-out recess 26 preferably extends along the entire length of the bent end section 18, although the present invention is not so limited, that is, cut-out recess 26 can extend along only a part of the length of bent end section 18, or there may be a plurality of spaced apart cut-out recesses 26.

Further, each bent end section 18 has a lower beveled end 18*a*.

In addition, preferably, although not required by the present invention, the opposite ends of each bent end section 18 have a rectangular cut-away section 30, as shown in FIG. 2, so that when bent end sections 18 are bent at right angles to main panel section 16, corner openings or cut-away sections are provided. With this arrangement, when primary walls panels 12 are secured to elongated main fastening extrusions that are secured to existing wall structure 14, primary wall panels 12 can merely be hung thereon and slid therealong, as a result of the corner openings.

As shown in FIG. 4, main fastening extrusions 32 are provided for securing each primary wall panel 12 to existing wall structure 14. Each main fastening extrusion 32 is preferably formed as a single, one-piece, unitary member that includes a base section 34 secured to existing wall structure 14 and a supporting section 36 to which a bent end section 18 of each primary wall panel 12 is secured. As with each primary wall panel 12, each main fastening extrusion 32 is formed preferably by, but not limited to, a polyethylene core 20 with a thin aluminum wall 22 covering opposite sides thereof. Alternatively, each main fastening extrusion 32 can be formed from polyvinyl chloride (PVC), aluminum or any other suitable material. It will be appreciated that base section 34 can be formed from a plurality of pieces instead.

Base section 34 includes a central planar wall 38 that seats flush against existing wall structure 14, and which has a plurality of linearly aligned openings 40 extending therealong and through which screws (not shown) can be inserted to secure central planar wall 38 to existing wall structure 14.

Supporting section 36 includes two, parallel, spaced apart, elongated post walls 42 extending outwardly at right angles from central planar wall 38 and extending the length of each main fastening extrusion 32. A first bent end securing wall 44*a* extends outwardly at right angles from central planar wall 38 on an outer side of each post wall 42, with the spacing between each post wall 42 and each adjacent bent end securing wall 44*a* being equal to the thickness of one bent end section 18, and a second bent end securing wall 44*b* extends outwardly at right angles from central planar wall 38 on an inner side of each post wall 42, with the spacing between each post wall 42 and each adjacent bent end securing wall 44*b* being equal to the thickness of one bent end section 18. A spacing 45 is provided between adjacent bent end securing walls 44*b*.

Each bent end securing wall 44*a* and 44*b* includes a projection 46 at the surface thereof in facing relation to the adjacent post wall 42, with each projection 46 having a nose-shaped configuration in cross-section, which corresponds in shape and dimensions to nose-shaped cut-out recess 26, although the present invention is not limited thereby. Specifically, each projection 46 has an inclined surface 46*a* that slopes in a direction toward base section 34 and terminates at a holding surface 46*b* that extends parallel to central planar wall 38. Projection 46 preferably extends along the entire length of the respective bent end securing wall 44*a* or 44*b*, although the present invention is not so limited, that is, projection 46 can extend along only a part of the length of the respective bent end securing wall 44*a* or 44*b*, or there may be a plurality of spaced apart projections 46.

The inclined surface 46*a* of each inwardly directed projection 46 continues upwardly at an angle with an inclined wall 50, the free end 50*a* of which is intended to abut against the undersurface of main wall panel section 16 when inwardly directed projection 46 is positioned in cut out recess 26 so as to provide a snap-tight like action with a tight fit so that there is little or no play, whereby primary wall panels 12 are tightly held in position. However, inclined walls 50 are not a requirement of the present invention, and can be eliminated.

To assemble primary wall panels 12 with main fastening extrusions 32, it is only necessary to press bent end sections 18 into the space between a post wall 42 and an adjacent bent end securing wall 44*a*, whereby the bent end securing wall 44*a* is biased away from the post wall 42, until holding surface 26*b* passes by holding surface 46*b*, whereupon bent end securing wall 44*a* springs back to its original position due to its resilience, whereby nose-shaped inwardly directed projection 46 engages in nose-shaped cut out recess 26. This is due to the resilient nature of bent end securing walls 44*a*, 44*b*. In such case, holding surface 46*b* engages holding surface 26*b* to prevent escape of bent end section 18. In such position, free end 50*a* of inclined wall 50 is in abutting or near abutting relation with the underside of the respective planar main panel section 16.

In accordance with the present invention, a secondary plug wall panel 52 is also snapped into position into extrusion 32 in covering relation to the space 45 between adjacent primary wall panels 12. In its simplest form, each secondary plug wall panel 52 is formed in the same manner as each wall panel 12, but is of much smaller dimensions, as shown best in FIG. 1. Thus, each secondary plug wall panel 52 includes a rectangular shaped, planar main plug panel section 54 and at least two bent end sections 56 bent at a right angle in the same direction at edges of main plug panel section 54. Main plug panel section 54, however, need not be planar, and in fact, can have different shapes, such as a wave shape, etc. to provide different aesthetic appearances. Preferably, there are four bent end sections 56 at each edge of main plug panel section 54 which form an L-shaped cross-sectional shape thereat. However, the invention is not limited thereby and secondary plug wall panel 52 can be formed with two, three or four bent end sections 56. Each secondary plug wall panel 52 is formed preferably by, but not limited to, a polyethylene core 20 with a thin aluminum wall 22 covering opposite sides thereof, of the type shown in FIG. 3. However, for the sake of simplicity in the drawings, all of the drawings show secondary plug wall panels formed of only a single material. Thus, as with wall panels 12, each secondary plug wall panel 52 includes a cut-out recess 58 extending the length of the inner surface of each bent end section 56, and spaced slightly away from main plug panel section 54. Each cut-out recess 58 has an acute angle, nose-shaped configuration in cross-section, as shown in FIG. 4, that effectively forms a notch in the inner surface of bent end section 56. Thus, each cut-out recess 58 has an inclined surface 58*a* that extends toward the distal end of the bent end section 56 at the inner surface thereof, and terminates at a holding surface 58*b* that extends parallel to main plug panel section 54. Cut-out recess 58 preferably extends along the entire length of the bent end section 56, although the present invention is not so limited, that is, cut-out recess 58 can extend along only a part of the length of bent end section 56, or there may be a plurality of spaced apart cut-out recesses 58.

Further, each bent end section 56 has a lower beveled end 56*a*.

The inclined surface 58*a* of each inwardly directed projection 58 continues upwardly at an angle with an inclined wall 60, the free end 60*a* of which is intended to abut against the undersurface of main plug panel section 54 when inwardly directed projection 46 is positioned in cut out recess 58 so as to provide a snap-tight like action with a tight fit so that there is little or no play, whereby secondary plug wall panels 52 are tightly held in position. However, inclined walls 60 are not a requirement of the present invention, and can be eliminated.

To assemble secondary plug wall panels 52 with main fastening extrusions 32, it is only necessary to press bent end sections 56 into the space between a post wall 42 and an adjacent bent end securing wall 44*b*, whereby the bent end securing wall 44*b* is biased away from the post wall 42, until holding surface 58*b* passes by holding surface 46*b*, whereupon bent end securing wall 44*b* springs back to its original position, whereby nose-shaped inwardly directed projection 46 engages in nose-shaped cut-out recess 58. In such case, holding surface 46*b* engages holding surface 58*b* to prevent escape of bent end section 56. In such position, free end 60*a* of inclined wall 60 is in abutting or near abutting relation with the underside of the respective planar main plug panel section 54.

Further, main plug panel section 54 can have a plurality of openings 55 through which light projects outwardly from a light source 57, such as a bulb, LED lights, etc., in spacing 45, as well as providing ventilation for spacing 45. Alternatively, openings 55 can be closed by transparent windows 59. In addition, other elements 61, such as electrical systems, such as cables, pipes for carrying various gases and/or liquids, solar panel pipes, a heat exchanger system, etc. can extend within spacing 45, being hidden by reason of main plug panel section 54.

Figure 7:
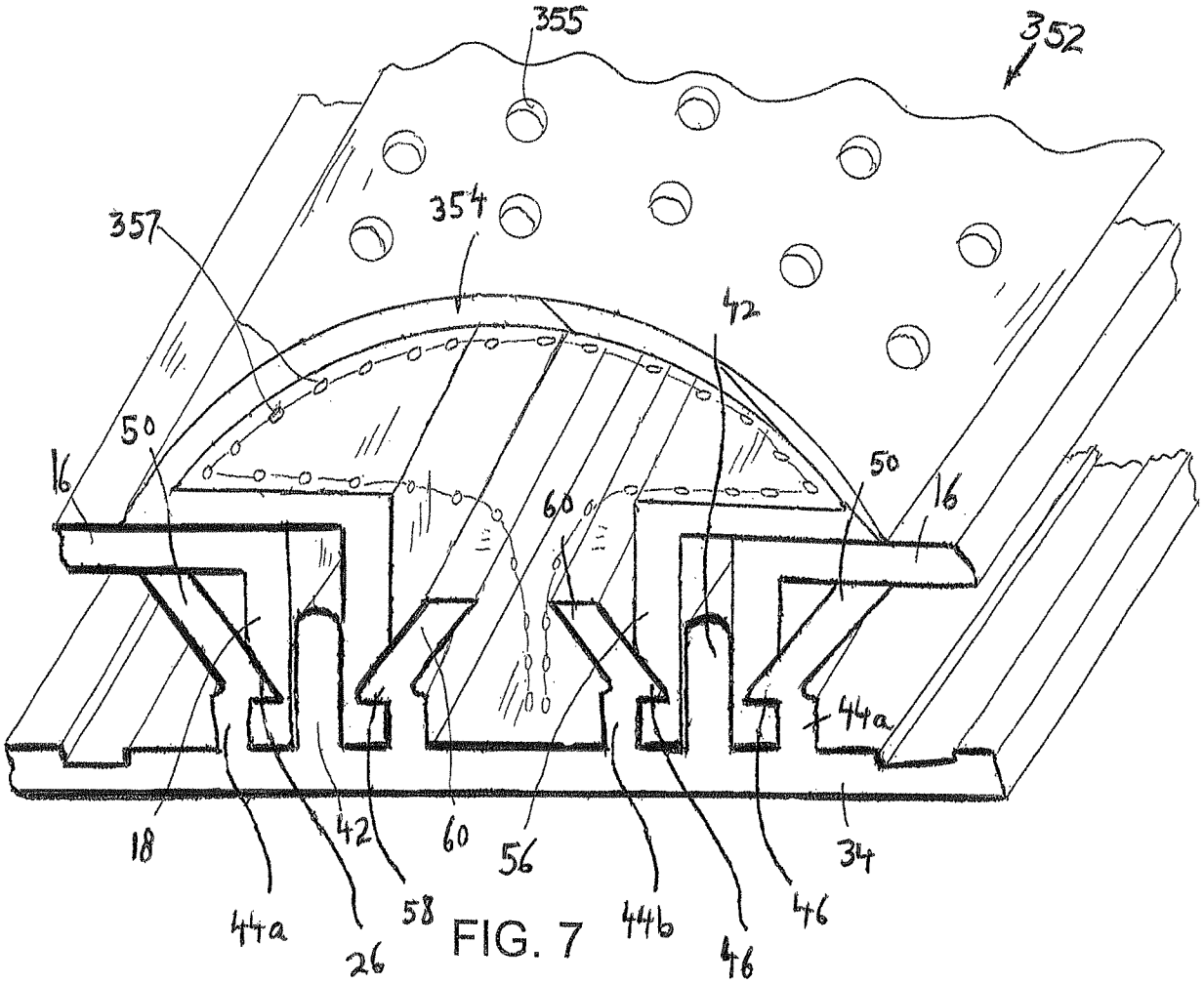
FIG. 7 is a perspective view of a system for mounting primary wall panels and third modified plug wall panels over an existing wall structure according to the present invention.
Figure 11:
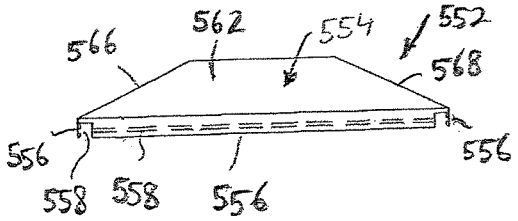
FIG. 11 is an end elevational view of the fifth modified plug wall panel.
Figure 12:
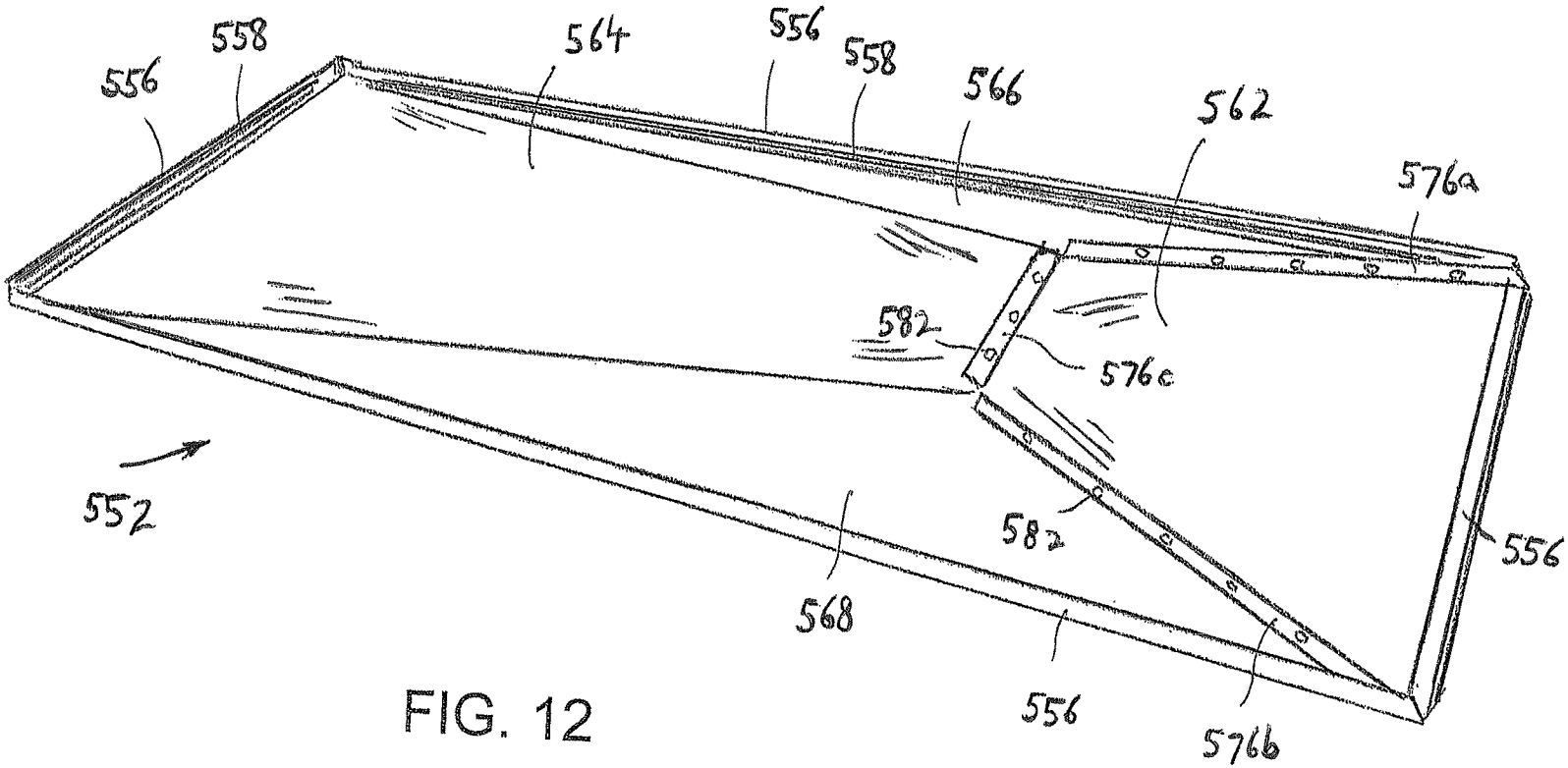
FIG. 12 is a bottom perspective view of the fifth modified plug wall panel.
Figure 14:
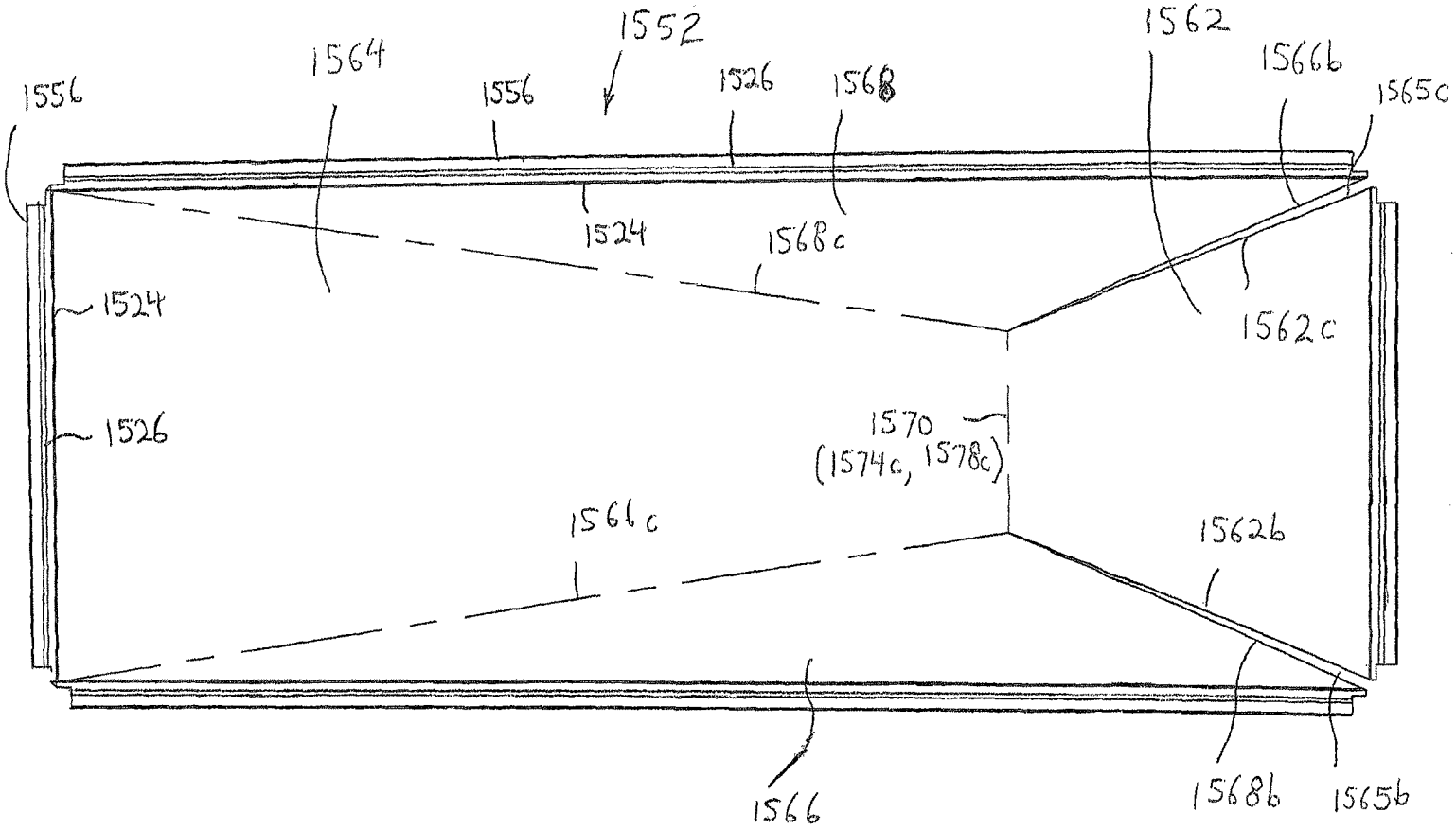
FIG. 14 is a bottom plan view of a blank for a sixth modified plug wall panel.
Figure 17:
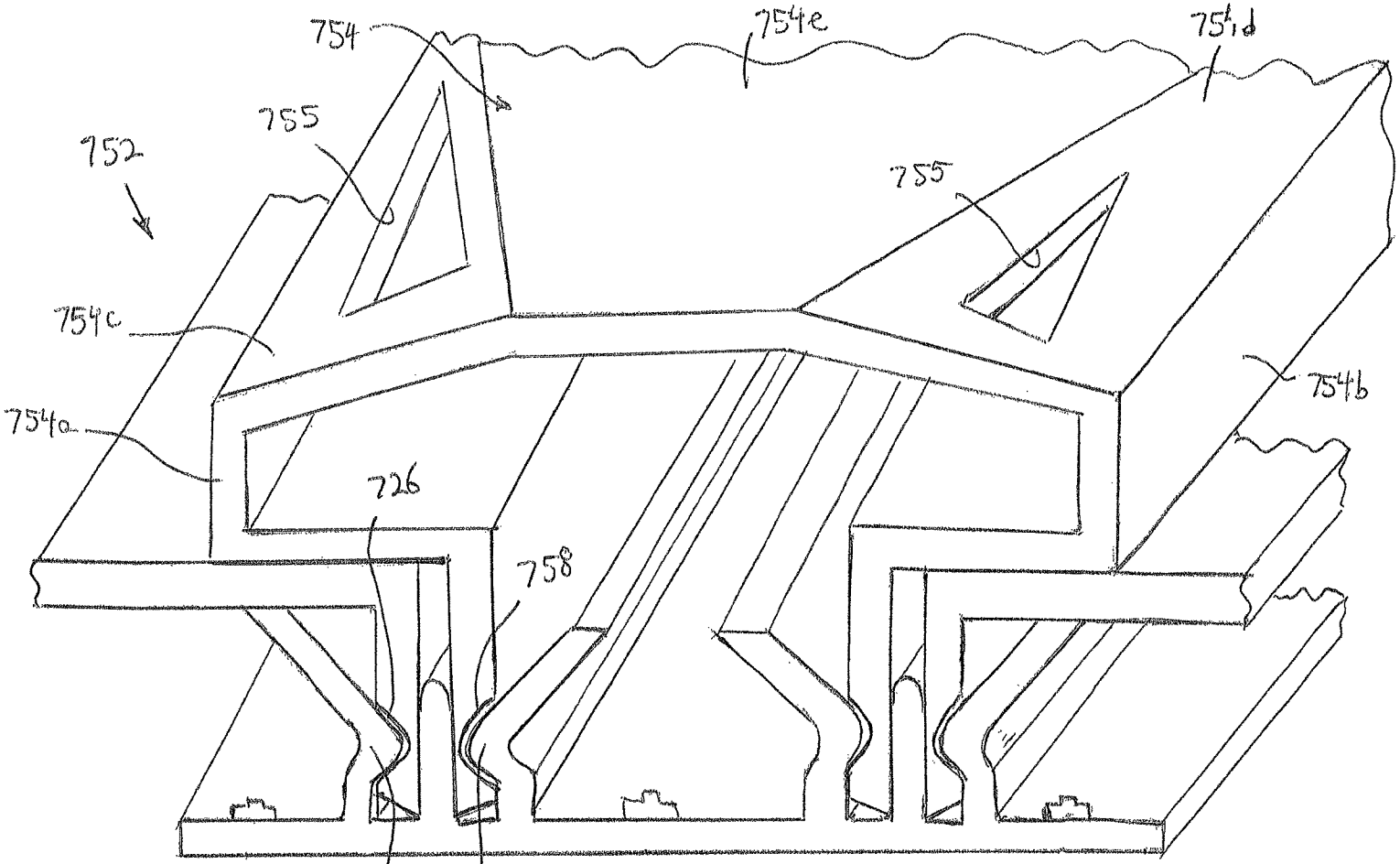
FIG. 17 is an elevational view of an eighth modified plug wall panel removably mounted to an existing wall structure.

It will be appreciated that many variations can be provided with the present invention within the scope of the claims. For example, the shapes of the projections 46 and the corresponding cut-out recesses 26, 58 can vary in accordance with any of the different shapes and sizes of the same elements disclosed in the aforementioned U.S. Pat. Nos. 8,739,483, 8,925,271 and 8,966,849 to the same inventor herein, the entire disclosures of which are incorporated herein by reference. Thus, for example, recesses 26, 58 can be square shaped recesses as shown in FIGS. 14 and 17 of U.S. Pat. No. 8,739,483 and FIG. 10 of U.S. Pat. No. 8,925,271 for engagement with nose-shaped projections 46. Alternatively, rather than pressing bent end sections 18, 56 into the spacing between post walls 42 and bent end securing walls 44*a*, 44*b*, bent end sections 18, 56 can be slid lengthwise therein. In such case, both projections 46 and cut-out recesses 26, 58 can have, for example, a square cross-sectional shape as shown in FIG. 7 of U.S. Pat. No. 8,925,271 or a trapezoidal cross-sectional shape as shown in FIGS. 11 and 12 of U.S. Pat. No. 8,925,271, or the like. Alternatively, rather than permanently locking in place, bent end sections 18 can be formed to be removed from extrusions 32 to replace a wall panel 12. In such case, V-shaped cut-out recesses 26, 58 would be provided, and projections 46 would have a similar V-shape, for example, of the type disclosed in U.S. patent application Ser. No. 14/044,606 to the same applicant herein, and the entire disclosure of which is incorporated herein by reference. Thus, recesses 26 can have a shape, for example, of a square shape, a rectangular shape, a triangular shape, a triangular shape with a rounded upper surface, a trapezoidal shape, and a cylindrical shape.

Figure 5:
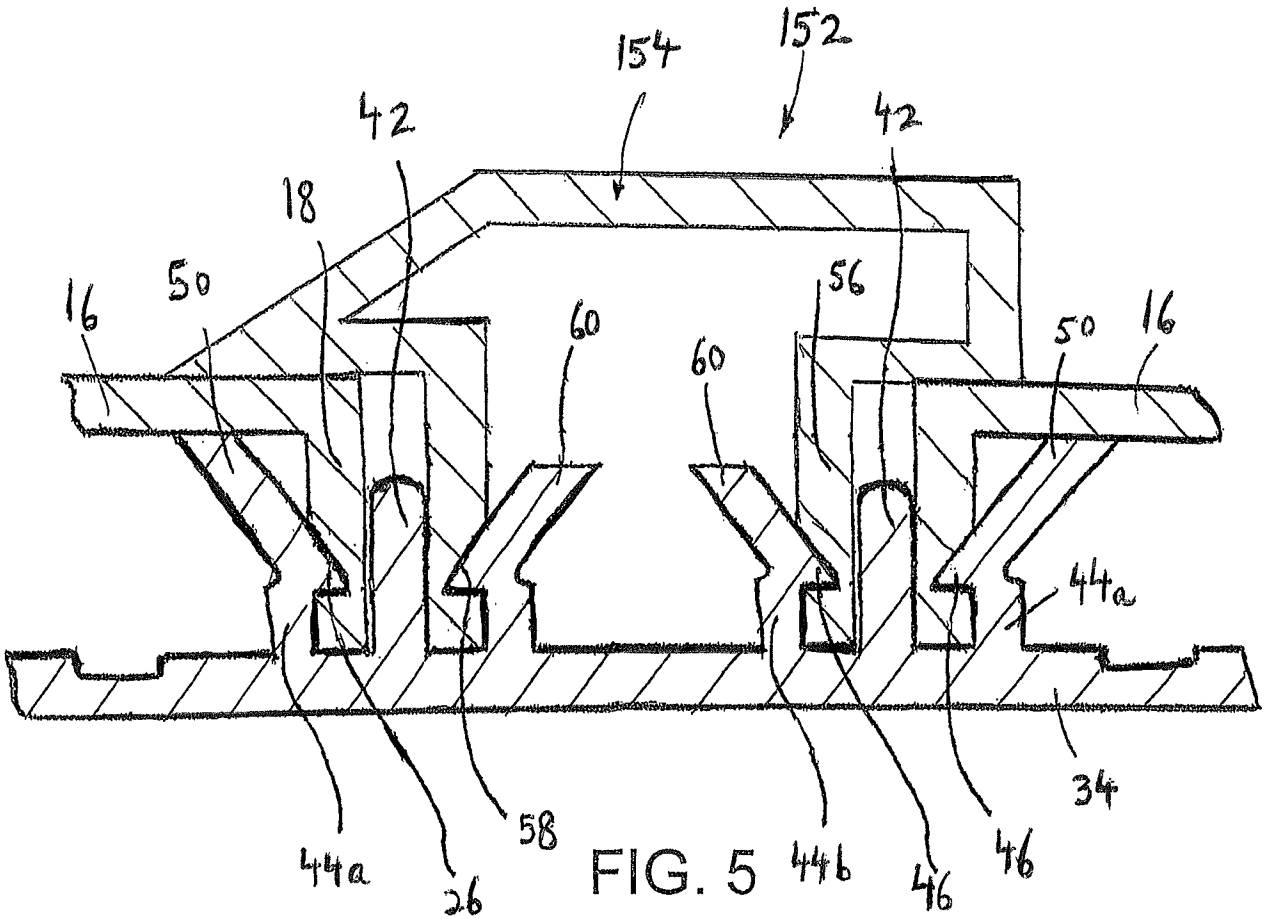
FIG. 5 is a cross-sectional view of a system for mounting primary wall panels and first modified plug wall panels over an existing wall structure according to the present invention.

Further, although bent end securing walls 44*a*, 44*b* are shown to be straight walls, extending at right angles from base section 34, they can have other configurations, such as the curved shapes as shown in U.S. Pat. No. 8,739,483. It will be appreciated that, with this arrangement, the plug elements can assume various shapes and sizes, to provide different aesthetic appearances. For example, as shown in FIG. 5, a first modified plug wall panel 152 is provided which is the same as plug wall panel 52, except that planar main plug panel section 54 is replaced with a trapezoidal shaped main plug panel section 154 in cross-section which overlies upper surfaces of main panel sections 16 of the adjacent wall panels 12.

Figure 6:
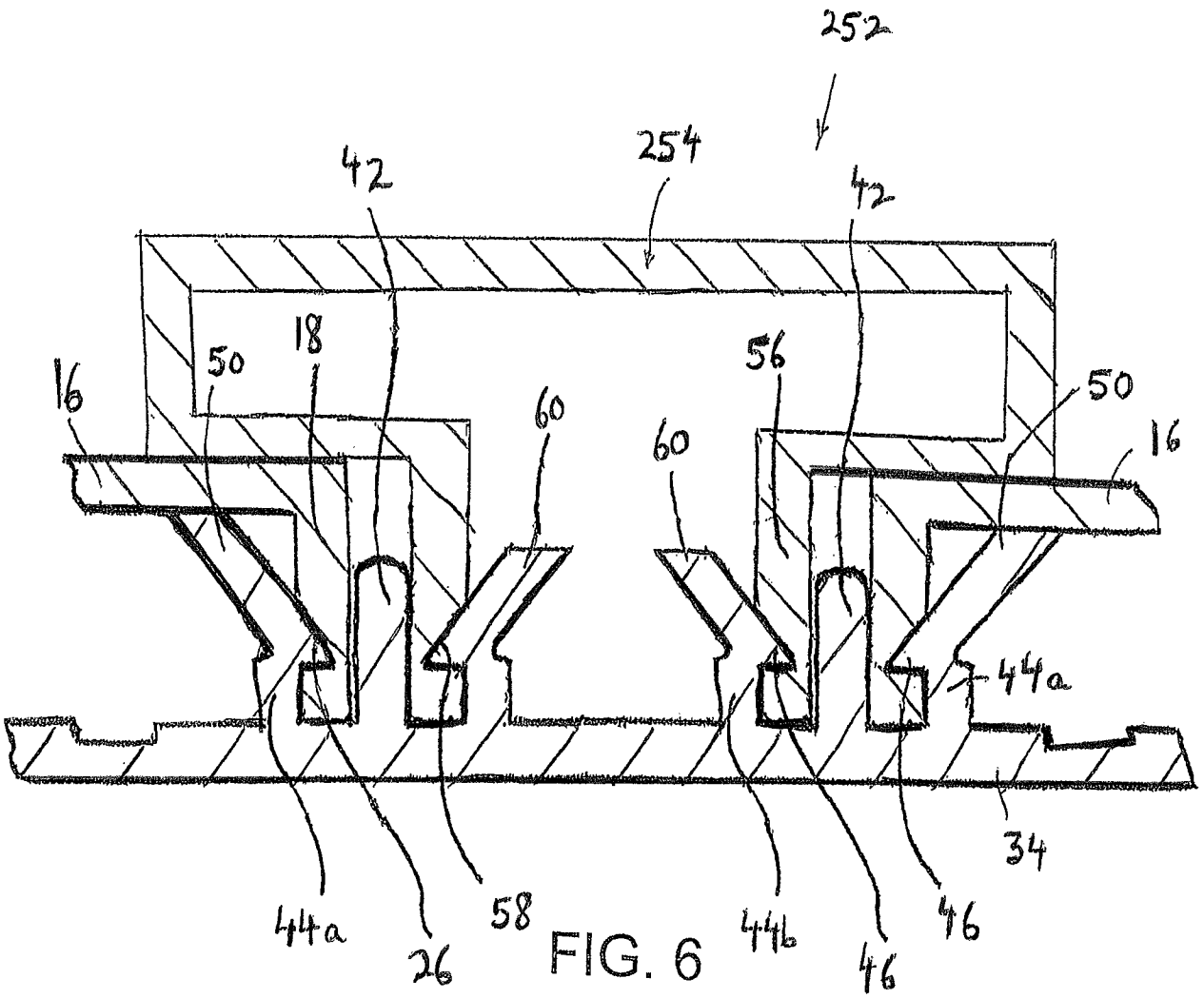
FIG. 6 is a cross-sectional view of a system for mounting primary wall panels and second modified plug wall panels over an existing wall structure according to the present invention.

Another variation is shown in FIG. 6, in which a second modified plug wall panel 252 is provided which is the same as plug wall panel 52, except that planar main plug panel section 54 is replaced with a rectangular shaped main plug panel section 254 in cross-section which overlies upper surfaces of main panel sections 16 of the adjacent wall panels 12.

Another variation is shown in FIG. 7, in which a third modified plug wall panel 352 is provided which is the same as plug wall panel 52, except that planar main plug panel section 54 is replaced with a mushroom shaped main plug panel section 354 in cross-section which overlies upper surfaces of main panel sections 16 of the adjacent wall panels 12. In addition, LED lights 357 are shown within spacing 345 immediately below mushroom shaped main plug panel section 354. In such case, a plurality of openings 355 are provided in mushroom shaped main plug panel section 354 to permit escape of the light from LED lights 357, and/or to provide ventilation. Openings 355 can be closed by transparent windows of the type shown in FIG. 4.

Figure 8:
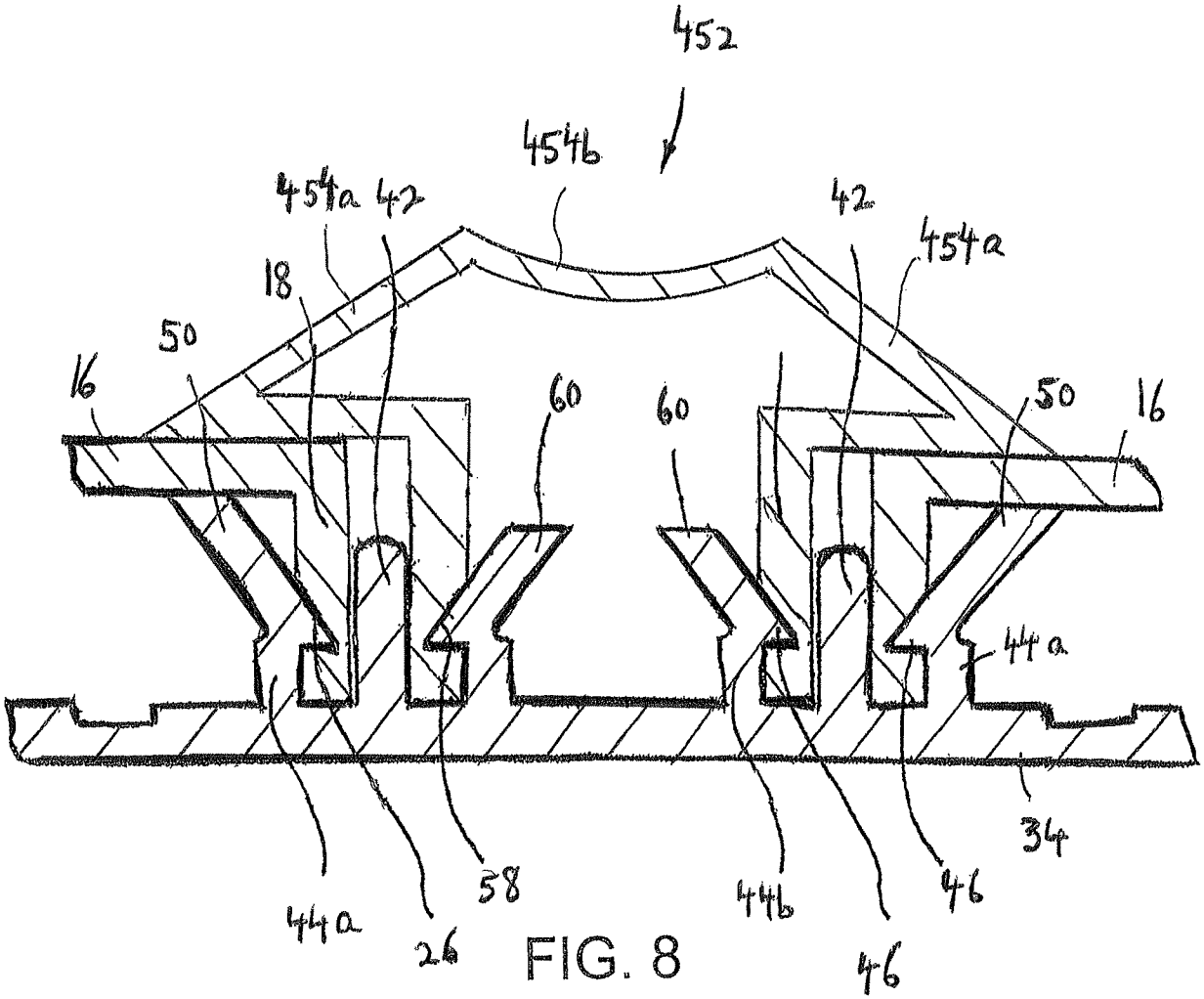
FIG. 8 is a cross-sectional view of a system for mounting primary wall panels and fourth modified plug wall panels over an existing wall structure according to the present invention.

Another variation is shown in FIG. 8, in which a fourth modified plug wall panel 452 is provided which is the same as plug wall panel 352, except that the upper curved surface of the mushroom shaped main plug panel section 354 is replaced with outwardly inclined surfaces 454*a* that meet at a central, upper concave surface 454*b*, and in which fourth modified plug wall panel 452 also overlies upper surfaces of main panel sections 16 of the adjacent wall panels 12.

The advantage of main plug panel sections 154, 254, 354, 454 overlying upper surfaces of main panel sections 16 of the adjacent wall panels 12, is that a seal is provided thereat to prevent liquids from entering therein. This can be further enhanced by a sealant between these elements.

FIGS. 9-12 show a fifth modified plug wall panel 552 of a different construction. Specifically, plug wall panel 552 is formed with a main plug panel section 554 having a rectangular perimeter and four bent end sections 556 at each side of the rectangular main plug panel section 554, with each bent end section 556 including a cut-out recess 558 on the inner surface thereof. Main plug panel section 554 has a roof like shape that has four surfaces 562, 564, 566 and 568 that all meet at a common line 570, and each extending up and inwardly from an edge of the rectangular perimeter of main plug panel section 554. Surface 562 has a trapezoidal shape with the larger side 562*a* thereof of the two parallel sides of the trapezoid forming a shorter edge of the rectangular perimeter and the shorter side of the two parallel sides of the trapezoid being formed by the common line 570. Surface 564 also has a trapezoidal shape with the larger side 564*a* thereof of the two parallel sides of the trapezoid forming the other shorter edge of the rectangular perimeter and the shorter side of the two parallel sides of the trapezoid being formed by the common line 570. Trapezoidal surface 564 has longer side edges 564*b*, 564*c* than those 562*b*, 562*c* of trapezoidal surface 562, so that common line 570 is off center to one side of the rectangular perimeter. As a result of this construction, surfaces 566 and 568 have triangular shapes, with one side 566*a*, 568*a* of each triangular shaped surface 566, 568 forming a longer edge of the rectangular perimeter, a second side 566*b*, 568*b* of each triangular shaped surface 566, 568 connected with one side edge 562*c*, 562*b* of trapezoidal surface 562, and the third side 566*c*, 568*c* of each triangular shaped surface 566, 568 connected with one side edge 564*c*, 564*b* of trapezoidal surface 564. The upper apices 566*d*, 568*d* of triangular shaped surfaces 566, 568 are formed at opposite ends of common line 570.

Figure 13:
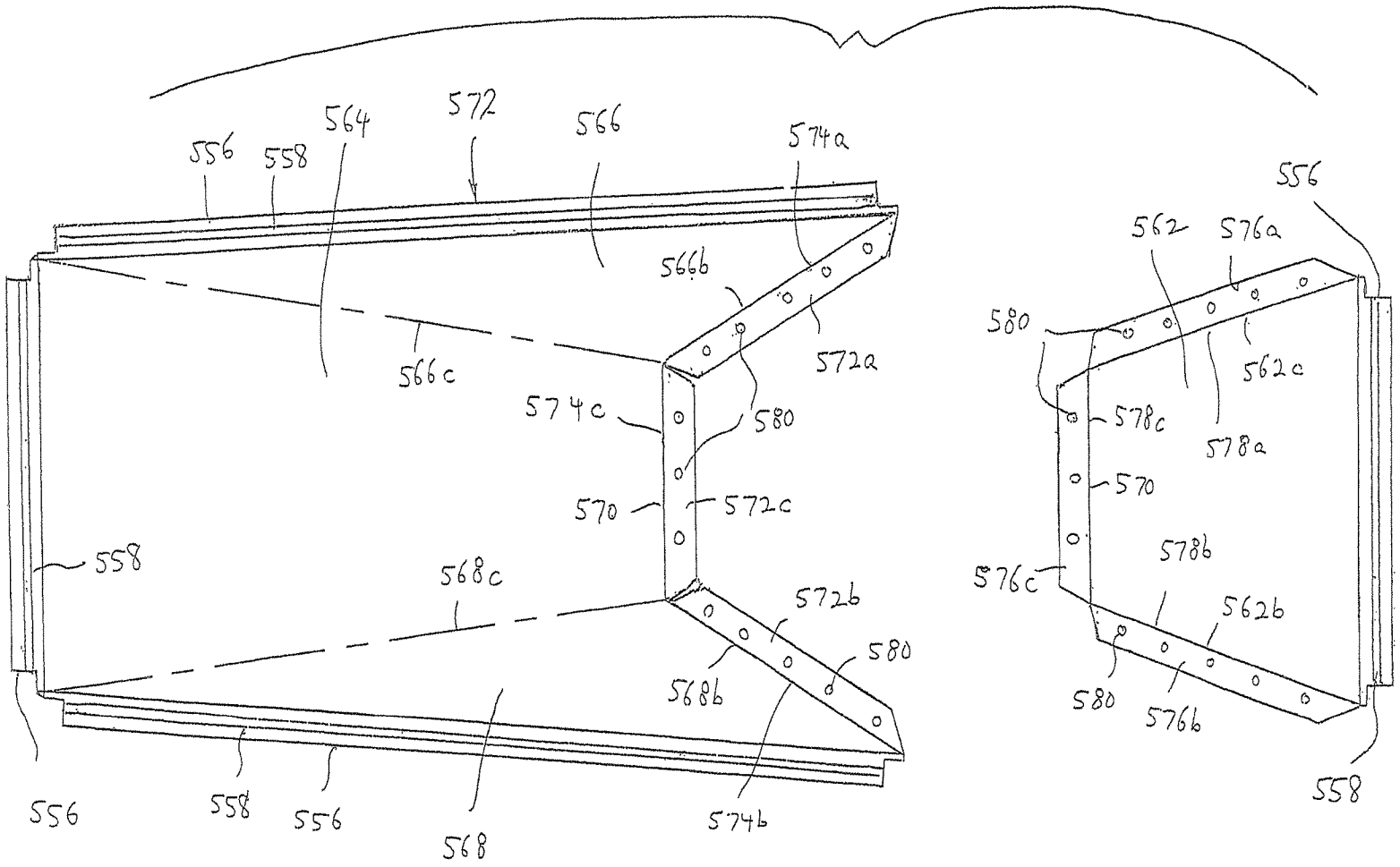
FIG. 13 is a bottom plan view of the fifth modified plug wall panels, before assembly thereof.

Because it is difficult to form plug wall panel 552 in a single piece, surfaces 564, 566 and 568 are formed as a single piece element 572, as shown in FIG. 13, with fold lines thereof corresponding to the third sides 566*c*, 568*c* of each triangular shaped surface 566, 568. Trapezoidal surface 562 is formed separate from single piece element 572. In order to connect trapezoidal surface 562 to single piece element 572, single piece element 572 is formed with three foldable edge strips 572*a*, 572*b* and 572*c* connected to the second sides 566*b*, 568*b* of triangular shaped surfaces 566, 568 and to common line 570. Each strip 572*a*, 572*b* and 572*c* is bendable inwardly at a right angle along a respective fold line 574*a*, 574*b* and 574*c*.

In like manner, trapezoidal surface 562 is formed with three edge strips 576*a*, 576*b* and 576*c* connected to the non-parallel sides 562*c*, 562*b* of the trapezoid shape and to the shorter 570 of the parallel sides of the trapezoid shape. Each strip 576*a*, 576*b* and 576*c* is bendable inwardly at a right angle along a respective fold line 578*a*, 578*b* and 578*c*.

Further, each strip 572*a*, 572*b* and 572*c* and each strip 576*a*, 576*b* and 576*c* includes a plurality of spaced openings 580 therealong.

Figure 51:
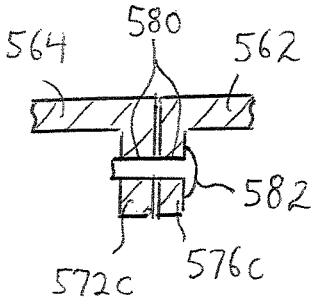
FIG. 51 is a cross-sectional view showing the connection of two adjacent sections of a wall panel by rivets inserted through adjacent bent strips thereof.
Figure 52:
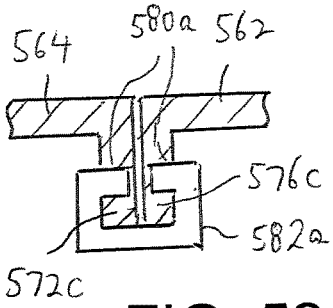
FIG. 52 is a cross-sectional view showing the connection of two adjacent sections of a wall panel by a first clamp inserted in adjacent bent strips thereof.
Figure 53:
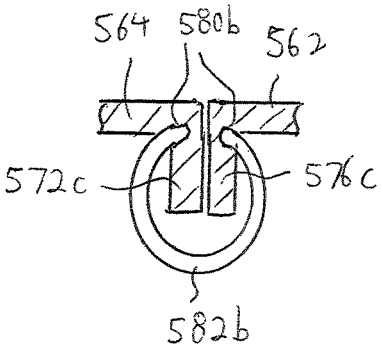
FIG. 53 is a cross-sectional view showing the connection of two adjacent sections of a wall panel by a second clamp inserted in adjacent bent strips thereof.
Figure 54:
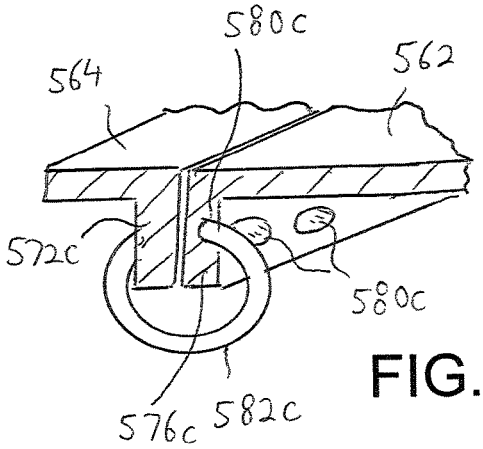
FIG. 54 is a cross-sectional view showing the connection of two adjacent sections of a wall panel by a third clamp inserted in adjacent bent strips thereof.

To assemble trapezoidal surface 562 with single piece element 572, and with each strip 572*a*, 572*b* and 572*c* and each strip 576*a*, 576*b* and 576*c* folded inwardly, strips 572*a*, 576*a*; strips 572*b*, 576*b*; and strips 572*c*, 576*c* are brought into flush contact with other, with the openings 580 in alignment, and screws, nuts and bolts, rivets or the like 582 are inserted therein, as shown in FIG. 51. Alternatively, rather than using screws, rivets or the like 582, any other suitable securing means can be used, for example, clamps 582*a*, 582*b* and 582*c*, as shown in FIGS. 52-54, in which the ends of the clamps are inserted within openings 580*a*, 580*b* and 580*c* in strips 572*a*, 572*b* and 572*c* and strips 576*a*, 576*b* and 576*c*. Alternatively, structural adhesives, structural caulking, aluminum strip flashing or tape secured by a structural adhesive or structural caulking or itself having a self-sticking material, or the like, can be used. Because each strip 572*a*, 572*b* and 572*c* and each strip 576*a*, 576*b* and 576*c* is folded inwardly, they are hidden from view when installed on the existing wall 14.

Figure 15:
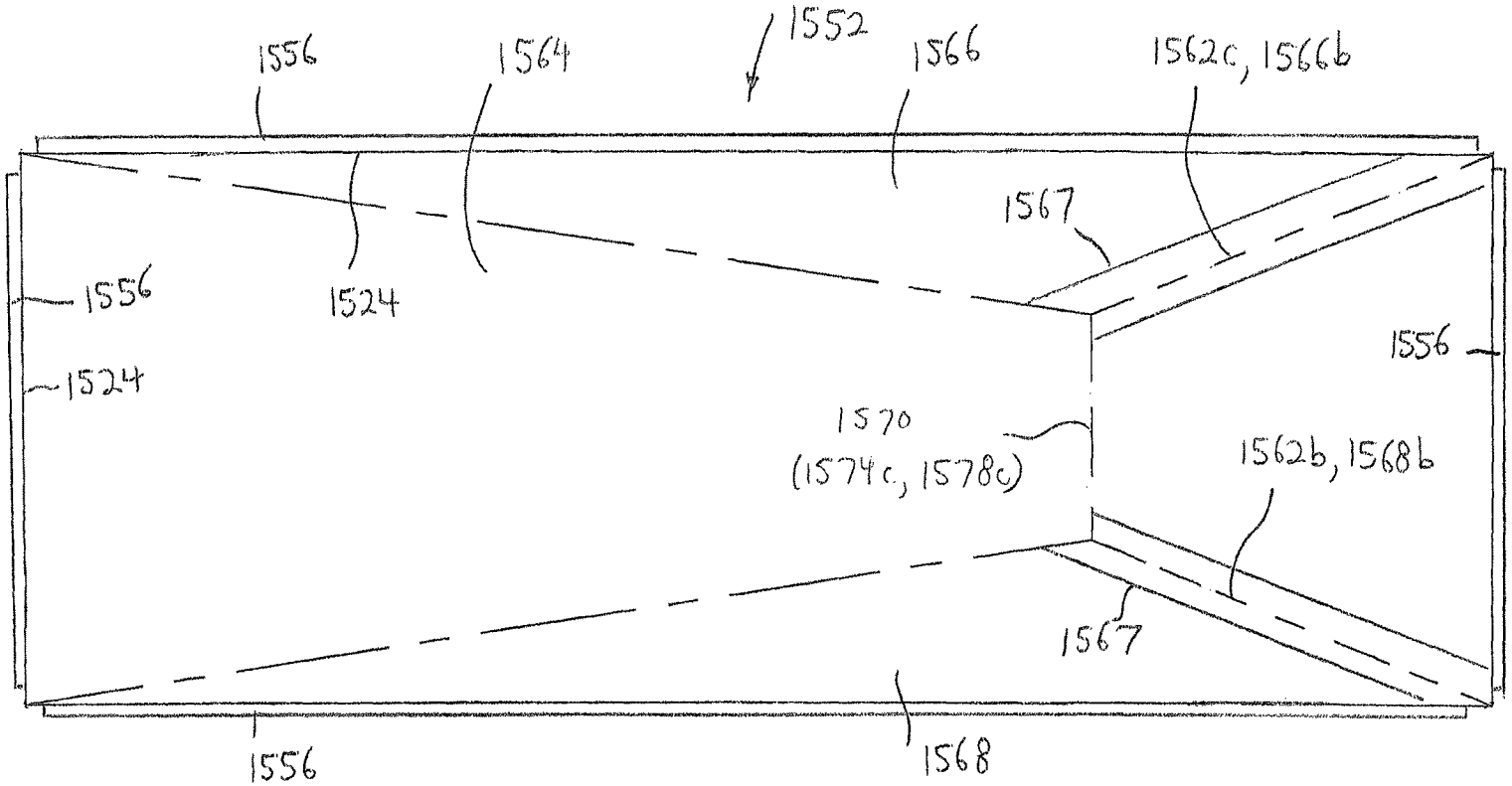
FIG. 15 is a bottom plan view of the sixth modified plug wall panel in assembled condition.

Alternatively, a sixth modified plug wall panel 1552 can be formed from a single stamped or cut element, as shown in FIGS. 14 and 15, in which elements corresponding to those of fifth modified plug wall panel 552 are incremented by 1000. In this case, shorter side 1578*c* of trapezoidal surface 1562 is connected with the shorter side 1574*c* of trapezoidal surface 1564 along common line 1570 which serves as a fold line, and edge strips 572*a*, 572*b*, 572*c*, 576*a*, 576*b* and 576*c* are eliminated. Side edges 1562*b* and 1568*b* are not connected to each other, and are separated by a small V-shaped gap 1565*b*, and in like manner, side edges 1562*c* and 1566*b* are not connected to each other, and are separated by a small V-shaped gap 1565*c*. In this manner, as shown in the assembled configuration of FIG. 5, when triangular surfaces 1566 and 1568 are folded along side edges 566*c* and 568*c* and when trapezoidal surface 1562 is folded relative to trapezoidal surface 1564 along common line 1570, side edges 1562*b* and 1568*b* are in abutting relation, and side edges 1562*c* and 1566*b* are in abutting relation, and can be connected together in any suitable manner. For example, as shown in FIG. 15, these side edges can be connected together by tape or aluminum strip flashing 1567 secured by a structural adhesive or structural caulking or itself having a self-sticking material, at the underside so as not to be visible from the outside. In addition, as shown in FIG. 15, bent end sections 1556 having cut-out recesses 1526 are bent down along V-shaped cut-outs 1524.

Figure 16:
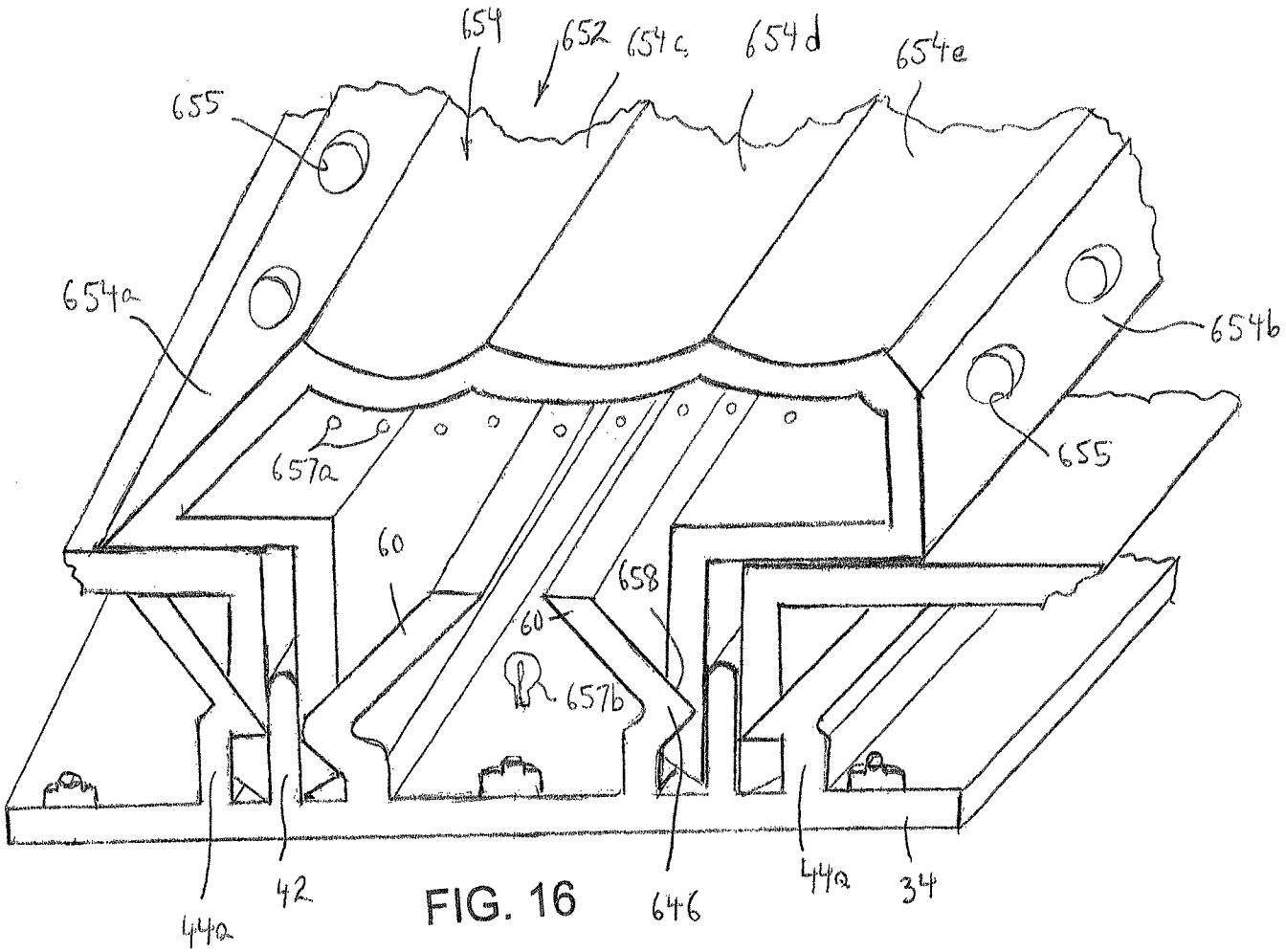
FIG. 16 is an elevational view of a seventh modified plug wall panel mounted to an existing wall structure.

Another variation is shown in FIG. 16, in which a seventh modified plug wall panel 652 is provided which is similar to plug wall panel 452, except that upper concave surface 454 is replaced with an upper wave-like section 654 formed by three contiguous upper concave surfaces 654*c*, 654*d* and 654*e*. Also, at only one side, there is an outwardly inclined surface or side panel 654*a* that meets one edge of upper wave-like section 654, and the opposite end provides a generally rectangular shaped side panel 654*b* similar to that of main plug panel section 254. In addition, openings 655 are provided in the side panels 654*a* and 654*b* for providing light from LED lights 657*a* and/or light bulbs 657*b* within seventh modified plug wall panel 652 and/or ventilation. In addition, it is noted that cut-out recesses 658, and projections 646 have V-shaped cross-sectional profiles, which secure seventh modified plug wall panel 652 in position, but also permit seventh modified plug wall panel 652 to be pulled out and replaced by another plug wall panel.

Another variation is shown in FIG. 17, in which an eighth modified plug wall panel 752 is provided which is similar to plug wall panel 252, except that upper concave surface 254 is replaced with an upper roof-like section 754 formed by three contiguous upper planar surfaces with the outer triangular planar surfaces 754*c* and 754*d* inclined upwardly from side panels 754*a* and 754*b*, and the center trapezoidal planar surface 754*e* connected between side edges of triangular planar surfaces 754*c* and 754*d*. In addition, triangular openings 755 are provided in triangular planar surfaces 754*c* and 754*d* for providing light from lights (not shown) within eighth modified plug wall panel 752 and/or ventilation. In addition, it is noted that cut-out recesses 726 and 758, and projections 746 have V-shaped or arcuate cross-sectional profiles, which secure eighth modified plug wall panel 752 in position, but also permit eighth modified plug wall panel 752 to be pulled out and replaced by another plug wall panel.

Figure 18:
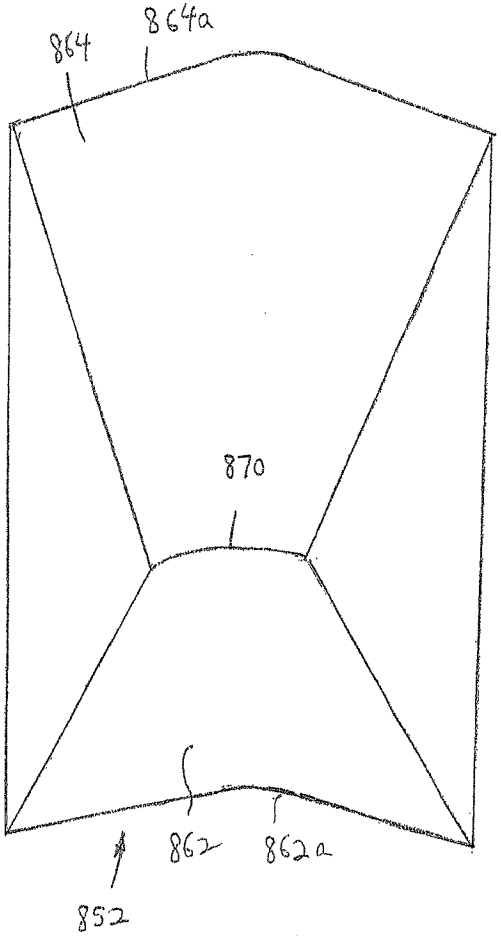
FIG. 18 is a top plan view of a ninth modified plug wall panel mounted to an existing wall structure.

Another variation is shown in FIG. 18, in which a ninth modified plug wall panel 852 is provided which is similar to plug wall panel 552, except that larger side 864*a* of trapezoidal surface 864 and larger side 562*a* of trapezoidal surface 652 are V-shaped rather than being straight, and common line 870 is curved.

Figure 19:
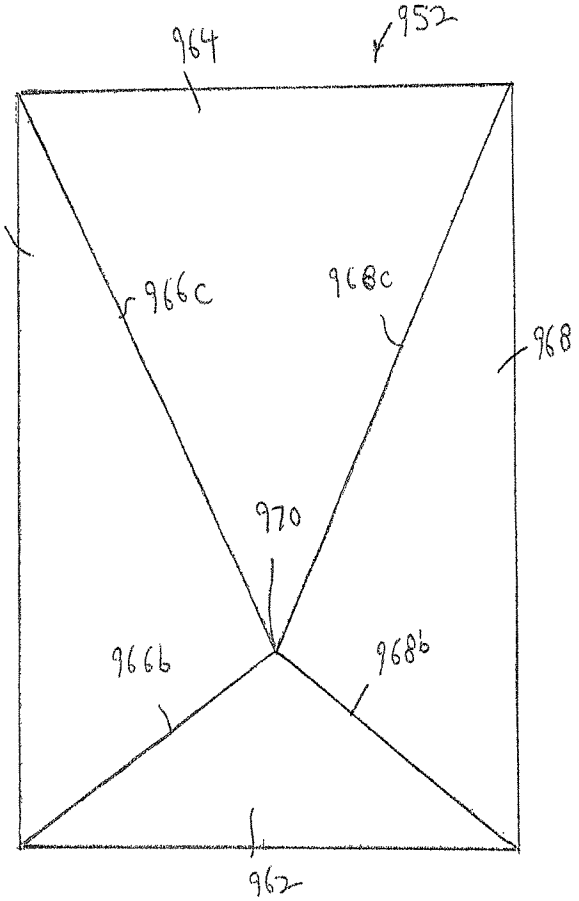
FIG. 19 is a top plan view of a tenth modified plug wall panel mounted to an existing wall structure.

Another variation is shown in FIG. 19, in which a tenth modified plug wall panel 952 is provided which is similar to plug wall panel 552, except that side edges 966*b*, 966*c*, 968*b* and 968*c* of triangular surfaces 966 and 968 meet at a common point 970 rather than a common line. As a result, the remaining surfaces 962 and 964 are also formed as triangular surfaces, thereby imparting a pyramid shape to tenth modified plug wall panel 952.

Figure 20:
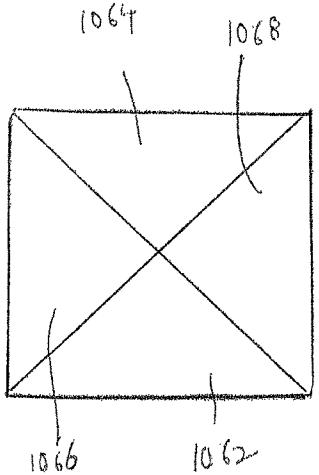
FIG. 20 is a top plan view of an eleventh modified plug wall panel mounted to an existing wall structure.

Another variation is shown in FIG. 20, in which an eleventh modified plug wall panel 1052 is provided which is similar to plug wall panel 952, except that all triangular surfaces 1062, 1064, 1066 and 1068 are of equal sizes and shapes, so that the outer periphery of eleventh modified plug wall panel 1052 is a square.

Figure 21:
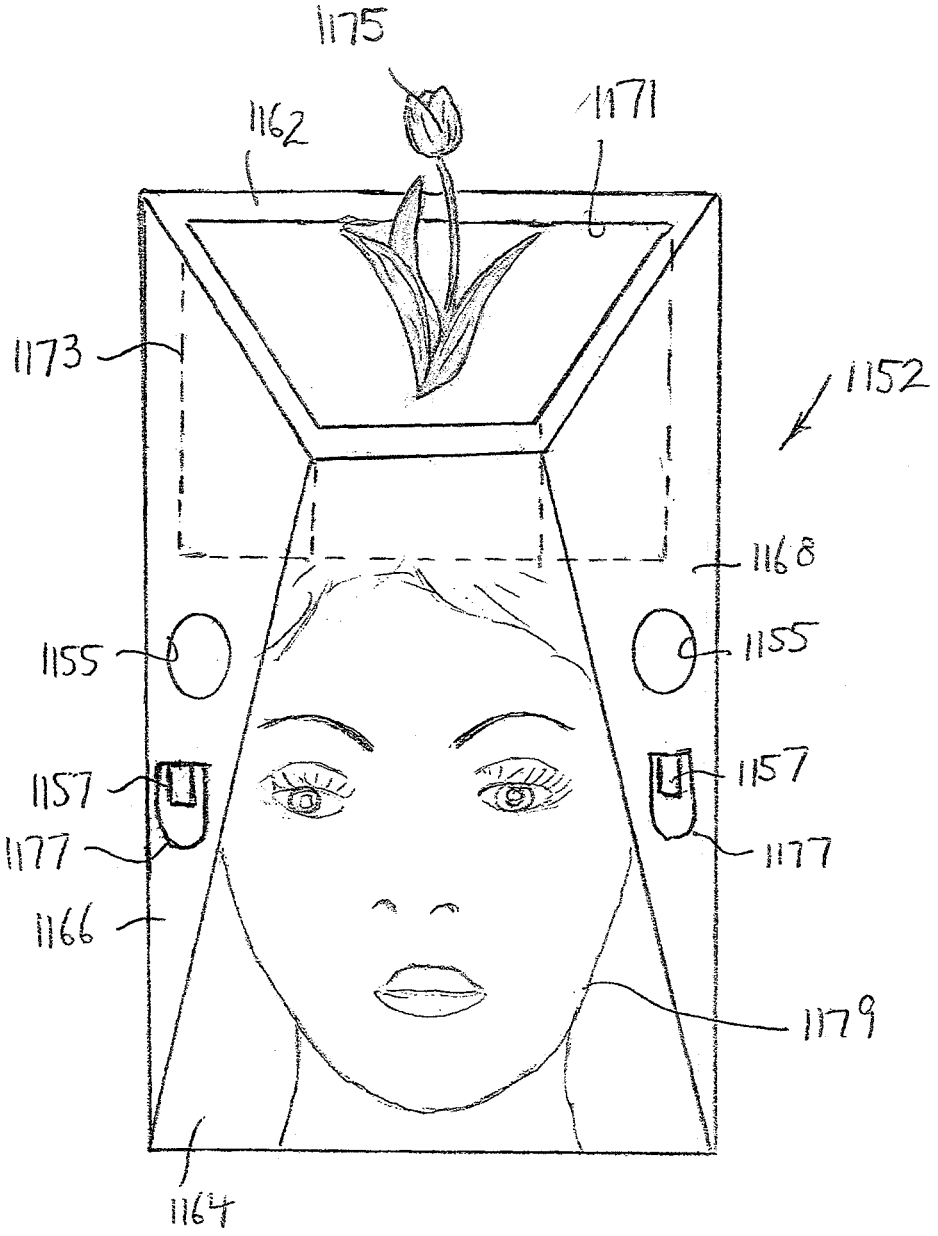
FIG. 21 is a top plan view of a twelfth modified plug wall panel mounted to an existing wall structure.

Another variation is shown in FIG. 21, in which a twelfth modified plug wall panel 1152 is provided which is similar to plug wall panel 552, except that an opening 1171 is provided in smaller trapezoidal surface 1162 and a planter box 1173 is mounted to base section 34 of main fastening extrusion 32, below opening 1171, for holding plants, flowers or other greenery 1175 therein that can extend out of opening 1171. Openings 1155 are also provided in triangular surfaces 1166 and 1168, and lights or candles 1157 are mounted to the outer surfaces of triangular surfaces 1166 and 1168 and covered by a transparent cover 1177. In addition, as shown, an aesthetic design or picture 1179 can be provided on the outer surface of trapezoidal surface 1164.

Figure 22:
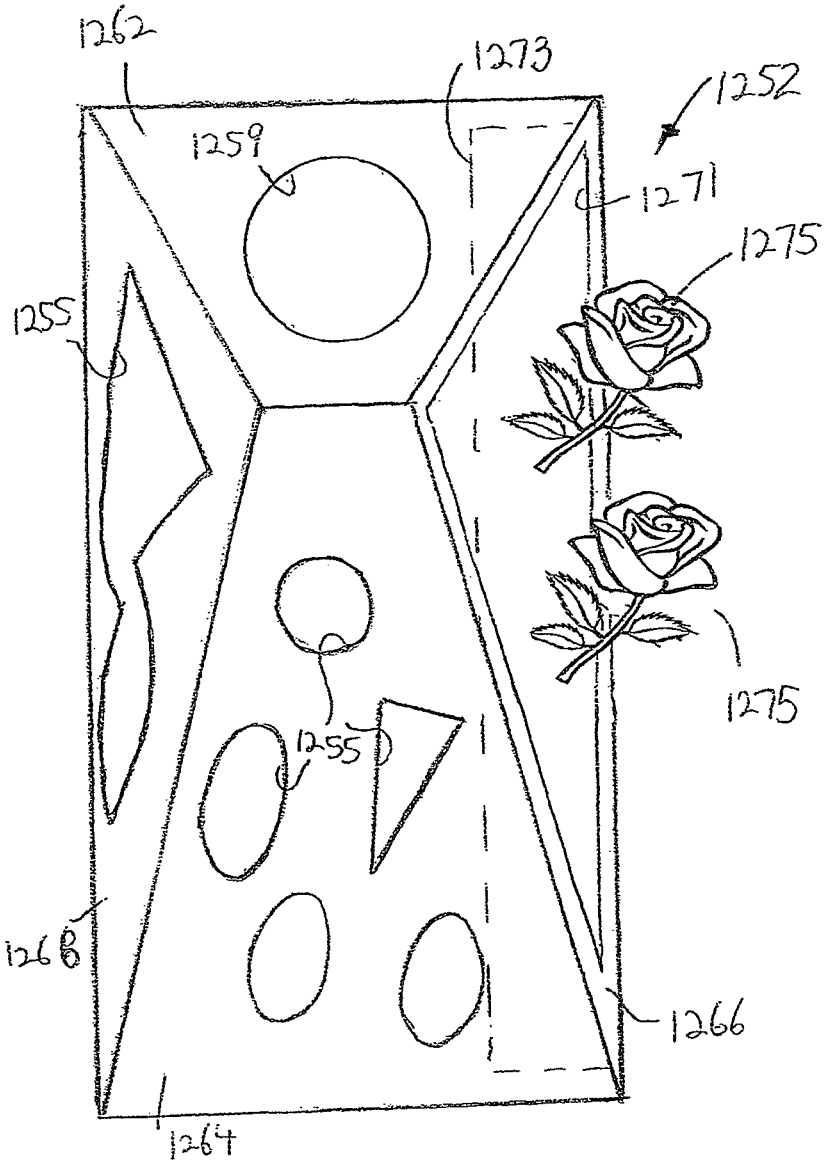
FIG. 22 is a top plan view of a thirteenth modified plug wall panel mounted to an existing wall structure.

Another variation is shown in FIG. 22, in which a thirteenth modified plug wall panel 1252 is provided which is similar to plug wall panel 1152, except that opening 1271 is provided in triangular surface 1266 and a planter box 1273 is mounted to base section 34 of main fastening extrusion 32, below opening 1271, for holding plants, flowers or other greenery 1275 therein that can extend out of opening 1271. Alternatively, planter box 1273 can be secured directly within and to the wall panel. Openings 1255 are also provided in triangular surface 1268 and larger trapezoidal surface 1264, and a transparent window 1259 is provided in smaller trapezoidal surface 1262 for emitting light from a light source (not shown) therethrough.

Figure 23:
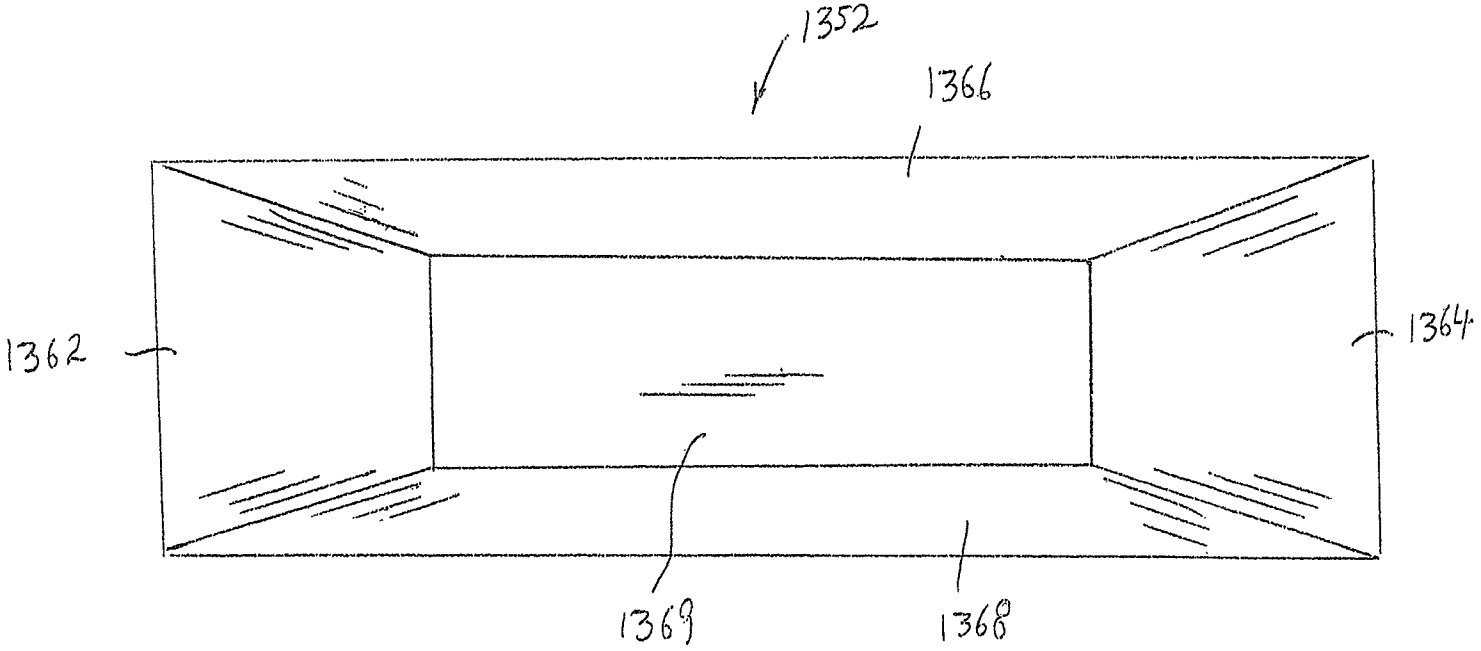
FIG. 23 is a top plan view of a fourteenth modified plug wall panel mounted to an existing wall structure.

Another variation is shown in FIG. 23, in which a fourteenth modified plug wall panel 1352 is provided which is similar to plug wall panel 552, except that triangular surfaces 566 and 568 are replaced by trapezoidal surfaces 1366 and 1368, so that all side surfaces 1362, 1364, 1366 and 1368 have trapezoidal configurations. As a result, a rectangular section 1369 is formed that is attached to the upper small sides of trapezoidal surfaces 1362, 1364, 1366 and 1368. With this arrangement, an aesthetic design or picture similar to picture 1179 can be provided on the outer surface of trapezoidal surface rectangular section 1369.

As a result of the above structure, the secondary plug wall panels 152-1552 provide a relief effect to the wall, enhancing the aesthetic appearance thereof. Specifically, main plug panel sections 154-1554 thereof are not coplanar with main panel sections 16 of primary wall panels 12, and thereby provide a three dimensional effect.

Figure 27:
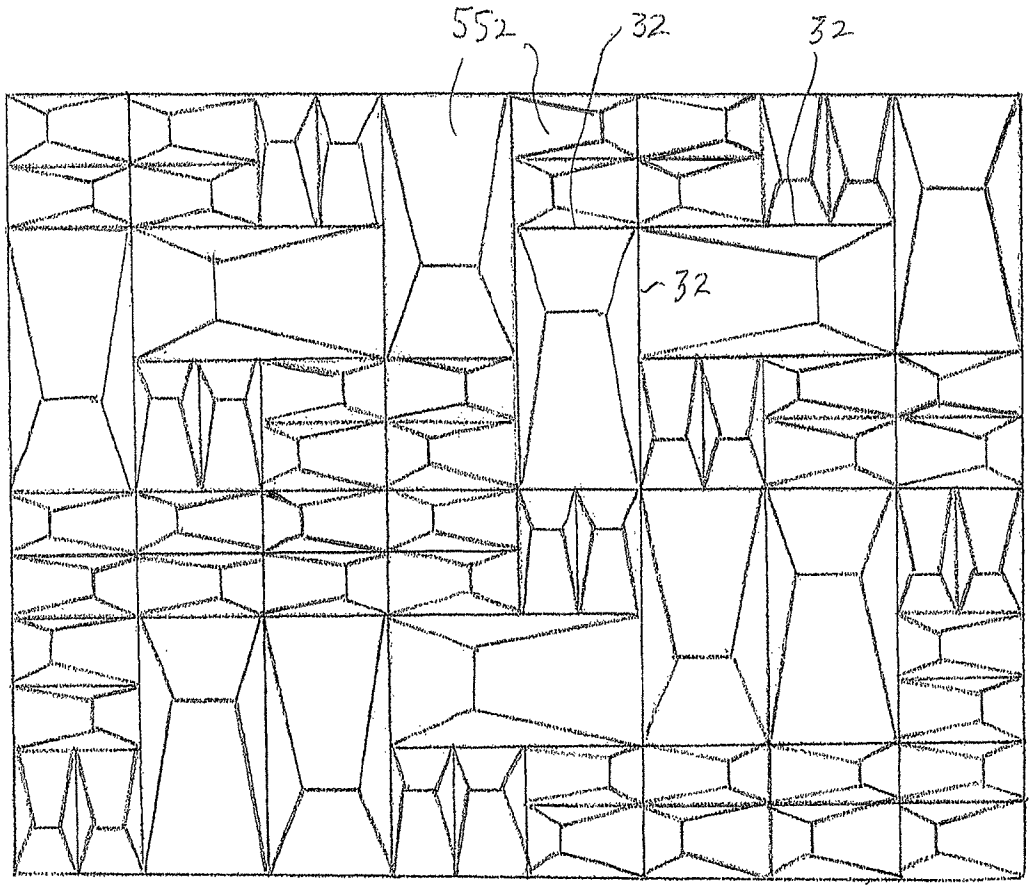
FIG. 27 is an elevational view of a plurality of a fifth modified plug wall panels mounted to an existing wall structure.

It will be appreciated, however, that the present invention is not limited to the use of secondary plug wall panels 52-1552 between adjacent primary wall panels 12, but instead, secondary plug wall panels 52-1552 can be used alone in varied arrangements on existing wall structure 14 as the sole wall panels, for example, as shown by the different sizes of fifth modified plug wall panels 552 assembled in the wall structure shown in FIG. 27, along with extrusions 32.

Figure 25:
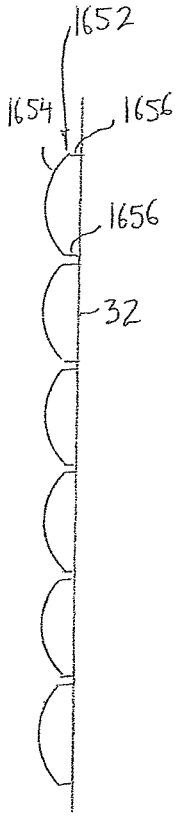
FIG. 25 is a schematic side elevational view of the assembled fifteenth modified plug wall panels of FIG. 24.
Figure 24:
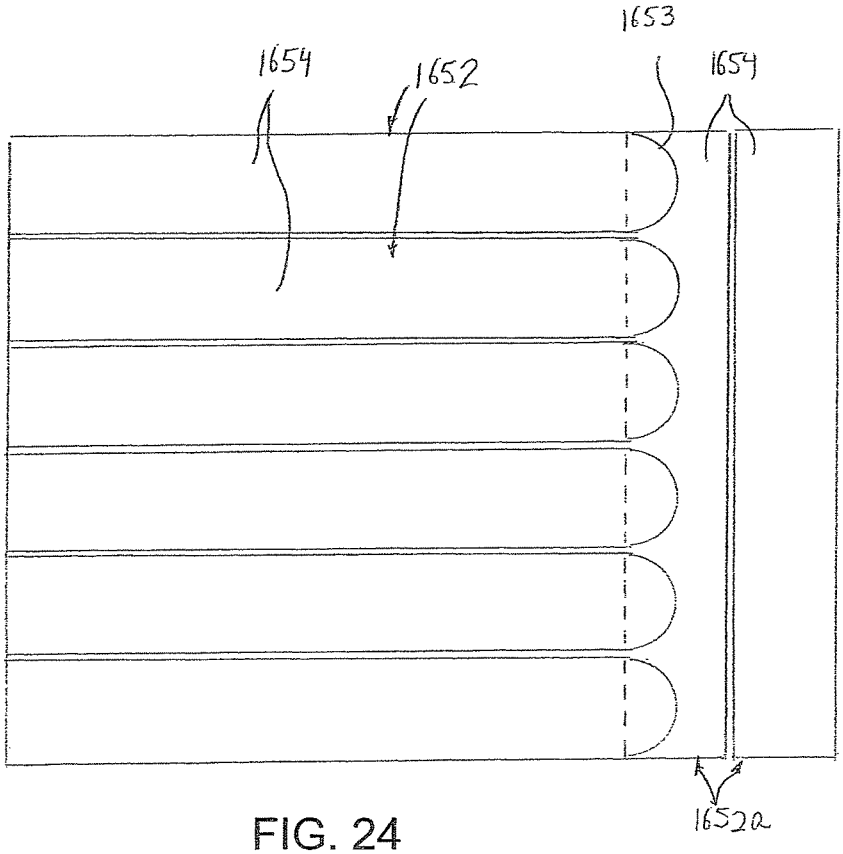
FIG. 24 is a top plan view of a fifteenth modified plug wall panel mounted to an existing wall structure.
Figure 26:
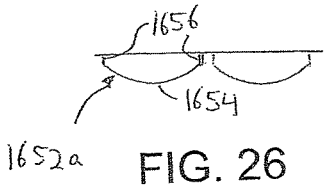
FIG. 26 is a schematic side elevational view of the transverse assembled fifteenth modified plug wall panels of FIG. 24.

Another variation is shown in FIGS. 24-26, in which secondary plug wall panels 1652 are formed with an elongated main plug panel section 1654 which is arcuate in a transverse direction thereof, and at least one end being formed with a rounded end 1653, although both ends can be rounded. Thus, as shown, the rounded ends 1653 of secondary plug wall panels 1652 overlapping and extending above main plug panel sections 1654 of transverse oriented secondary plug wall panels 1652*a*. Of course, secondary plug wall panels 1652 and 1652*a* both have bent end sections 1656 that snap fit within extrusions 32 which are only shown generically.

It will be appreciated that, while only one projection 48 has been shown in each bent end securing wall 44*a*, 44*b*, and only one cut-out recess 26 and 58 has been shown in each bent section 18, 56, a plurality of spaced apart projections 48 can be provided in each bent end securing wall 44*a*, 44*b*, and a plurality of spaced apart cut-out recesses 26 and 58 can likewise be provided each bent section 18, 56, to provide better securement of the wall panels.

Figure 9:
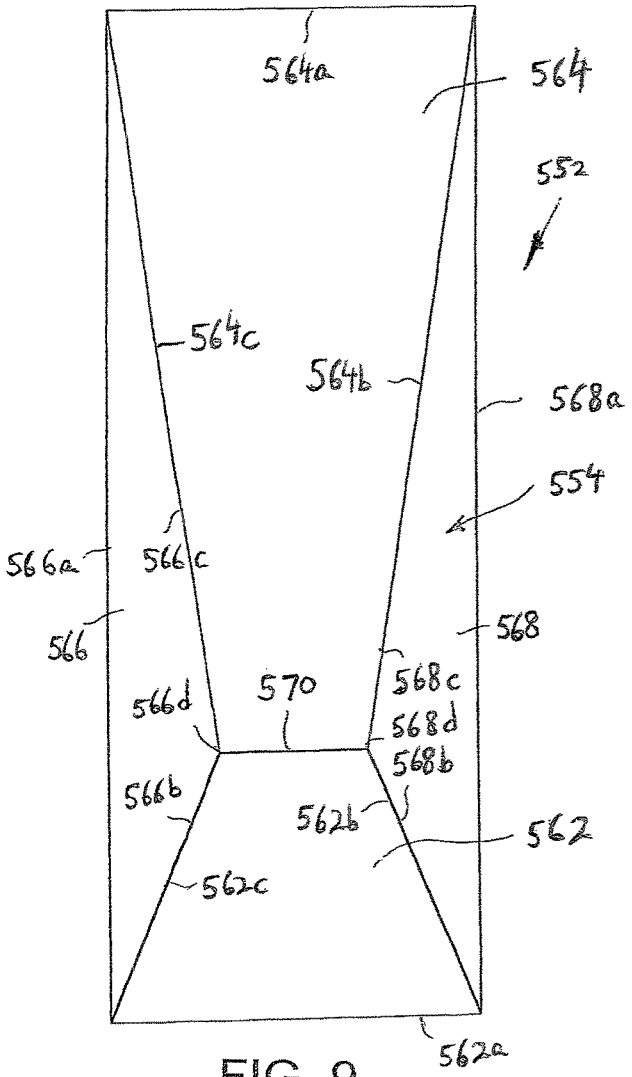
FIG. 9 is a top plan view of a fifth modified plug wall panel according to the present invention.

As described above in relation to FIGS. 9-13, trapezoidal surface 562 and single piece element 572 are each formed with bendable strips that are connected together to connect trapezoidal surface 562 with single piece element 572. This presents an outer appearance as shown in FIG. 9, in which there is only a straight line connection at edges between these elements. However, this assembly process also can be labor intensive with the use of bolts, rivets or the like 582. Further, it is not possible to provide decorative aesthetic effects on the outer surface at the joining lines.

Figure 28:
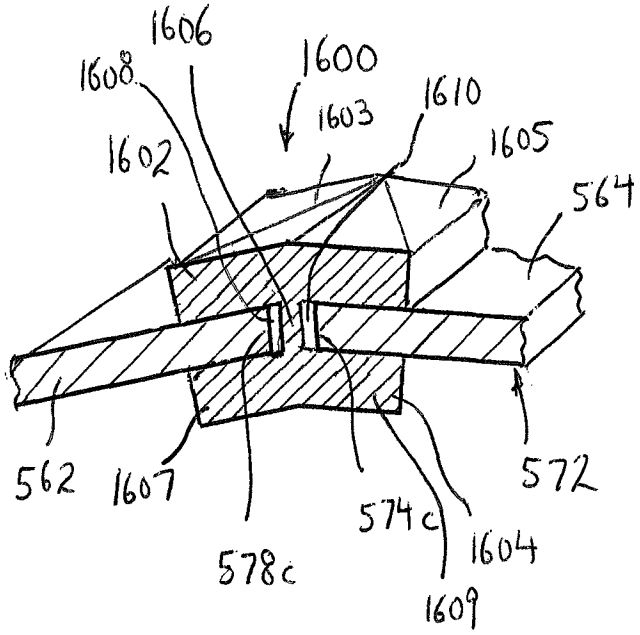
FIG. 28 is a perspective, cut-away view showing a connecting element which connects together sections of a wall panel.

Therefore, in accordance with the present invention, as shown in FIG. 28, a connecting element 1600 having a generally H-shaped cross-section can be used for connecting together adjacent edges of trapezoidal surface 562 and single piece element 572. H-shaped connecting element 1600 is preferably provided for connecting together edges 574*c* and 578*c* at common line 570.

Specifically, connecting element 1600 includes an upper plate 1602 and a spaced apart lower plate 1604 connected together by a central web plate 1606 that bisects and connects together upper plate 1602 and lower plate 1604. As a result, a first capture space 1608 is defined between upper plate 1602 and lower plate 1604 at one side of web plate 1606 and a second capture space 1610 is defined between upper plate 1602 and lower plate 1604 at the opposite side of web plate 1606.

The height of each capture space 1608 and 1610, as measured between upper plate 1602 and lower plate 1604 is substantially equal to the thickness of the material of trapezoidal surface 562 and trapezoidal surface 564 of single piece element 572. In this manner, as shown in FIG. 28, an edge of each of trapezoidal surface 562 and single piece element 572 can be inserted within the respective space 1608 and 1610 preferably with a slight friction fit, although a friction fit is not necessary since the structure will remain intact without a friction fit once assembled with the extrusion.

Figure 10:
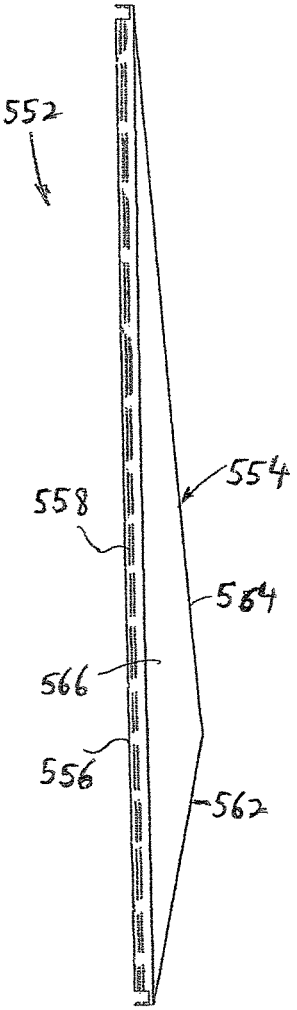
FIG. 10 is a side elevational view of the fifth modified plug wall panel.
Figure 29:
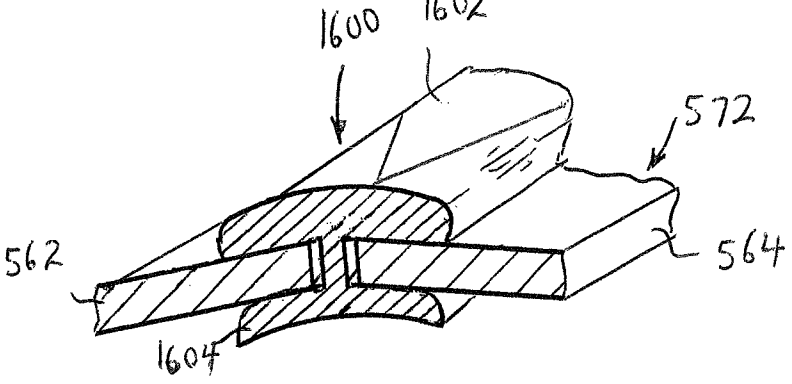
FIG. 29 is a perspective, cut-away view showing a first modified connecting element which connects together sections of a wall panel.

In addition, because trapezoidal surface 562 and single piece element 572 are angled relative to one another at common line 570, as best shown in FIG. 10, the portion 1603 of upper plate 1602 on one side of central web plate 1606 is preferably angled relative to the portion 1605 of upper plate 1602 on the opposite side of central web plate 1606. Alternatively, as shown in FIG. 29, to provide a different appearance, upper plate 1602 may be slightly curved or bowed, rather than being angled.

In like manner, as shown in FIG. 28, the portion 1607 of lower plate 1604 on one side of central web plate 1606 is preferably angled relative to the portion 1609 of lower plate 1604 on the opposite side of central web plate 1606. Alternatively, as shown in FIG. 29, to provide a different appearance, lower plate 1604 may be slightly curved or bowed, rather than being angled.

Figure 55:
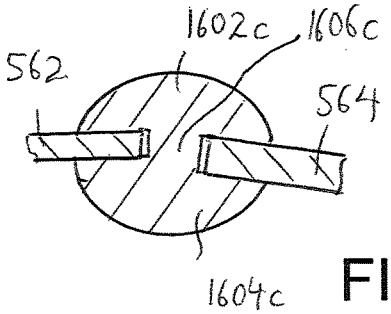
FIG. 55 is a cross-sectional view showing a ninth modified connecting element which connects together sections of a wall panel.

As a further modification, as shown in FIG. 55, both the upper plate 1602*c* and lower plate 1604*c* of connecting element 1600*c*, which are connected together by central web plate 1606*c*, can be curved or bowed, so that connecting element 1600*c* has a generally oval cross-sectional shape.

Figure 30:
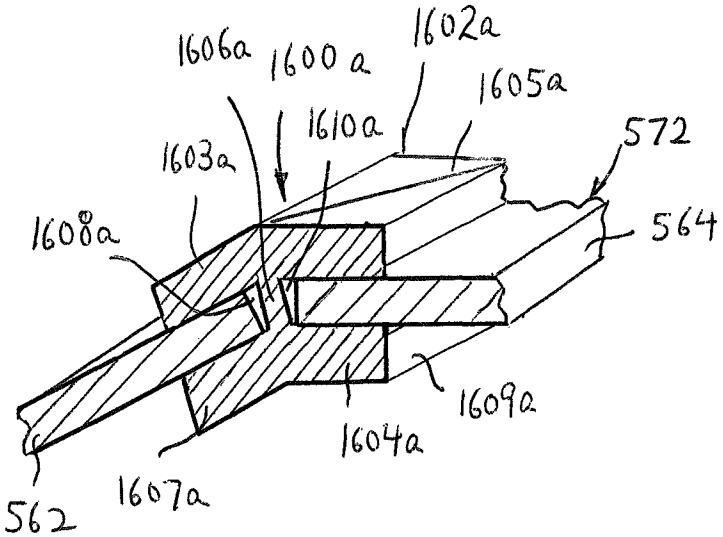
FIG. 30 is a perspective, cut-away view showing a second modified connecting element which connects together sections of a wall panel.
Figure 31:
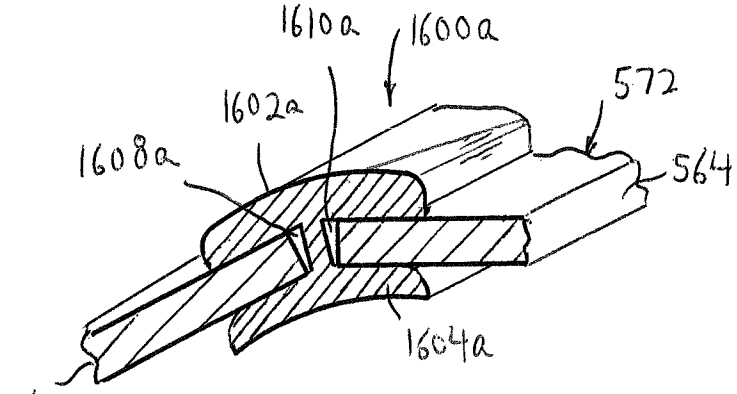
FIG. 31 is a perspective, cut-away view showing a third modified connecting element which connects together sections of a wall panel.

Because connecting edges 562*b*, 568*c* and 562*c*, 566*b* of trapezoidal surface 562 to triangular surfaces 566, 568 are generally connected at a greater angle than the edges at common line 570, a slightly modified connecting element 1600*a* is provided in which the portions 1603*a*, 1607*a* of upper plate 1602*a* and lower plate 1604*a* on one side of central web plate 1606*a* are angled relative to the portions 1605*a*, 1609*a* of upper plate 1602*a* and lower plate 1604*a* on the opposite side of central web plate 1606*a* of H-shaped connecting element 1600*a*, shown in FIG. 30, to a greater extent. Alternatively, as shown in FIG. 31, to provide a different appearance, upper plate 1602*a* and lower plate 1604*a* may be slightly curved or bowed, rather than being angled, but to a greater extent than upper plate 1602 and lower plate 1604 of connecting element 1600.

Connecting elements 1600 and 1600*a* preferably extend along the entire length of the connecting edges.

With this arrangement, not only is the connection made easier in order to form the wall panel, since it is only necessary to slide the edges of the sections into the respective spaces 1608, 1610 and 1608*a*, 1610*a*, but in addition, upper plates 1602 and 1602*a* provide a novel aesthetic look that enhances the appearance of the wall panel at the connecting edges, in addition to the affect achieved by the different sections of the wall panel extending at different angles relative to each other.

This novel aesthetic appearance can be further enhanced by providing a different color for upper plates 1602 and 1602*a*, that is, different than the outer surfaces of the remainder of the wall panel.

Figure 32:
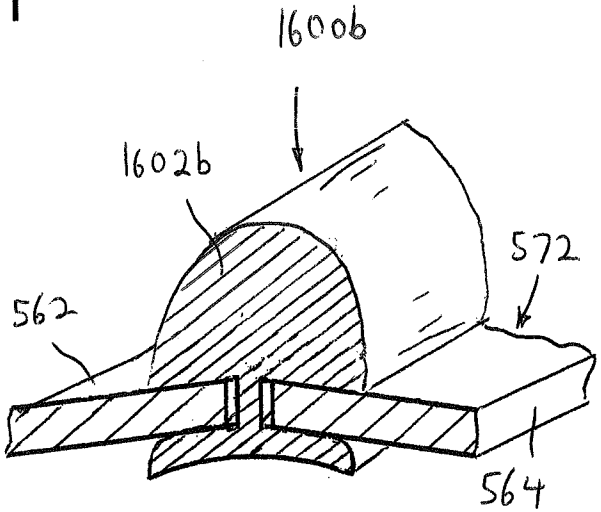
FIG. 32 is a perspective, cut-away view showing a fourth modified connecting element which connects together sections of a wall panel.
Figure 33:
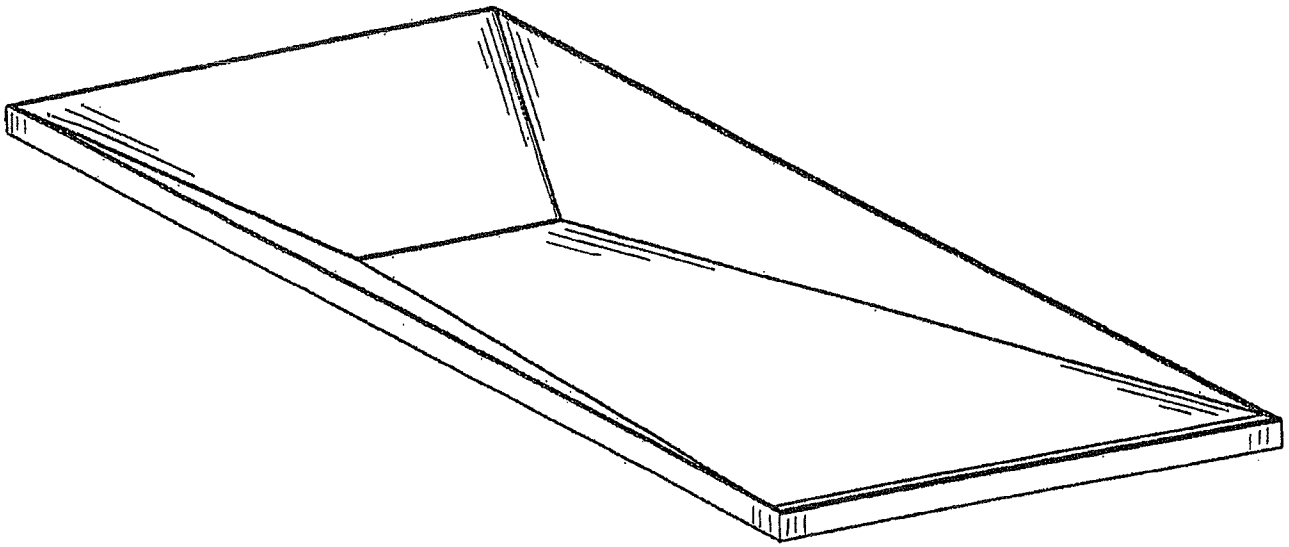
FIG. 33 is a perspective view of a sixteenth modified wall panel according to the present invention.
Figure 34:
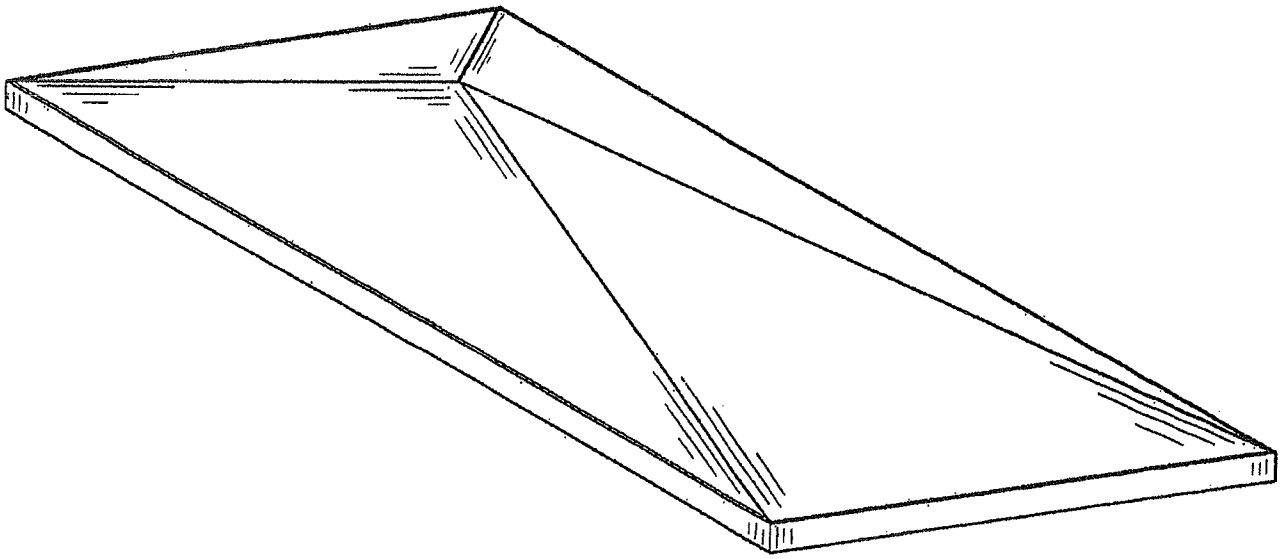
FIG. 34 is a perspective view of a seventeenth modified wall panel according to the present invention.
Figure 35:
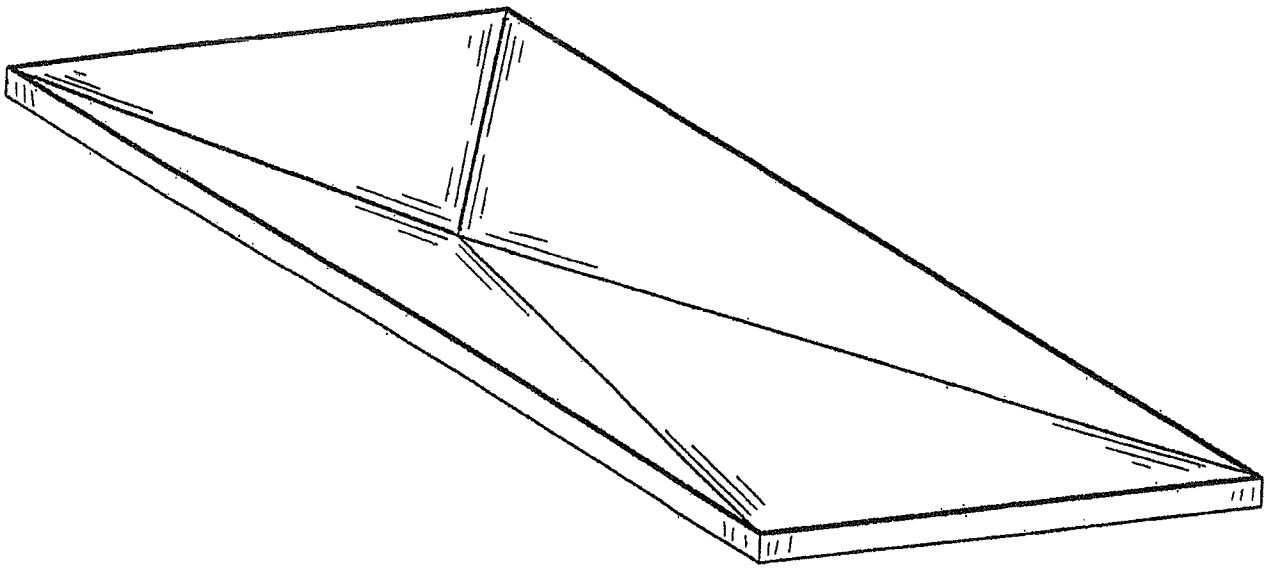
FIG. 35 is a perspective view of an eighteenth modified wall panel according to the present invention.
Figure 36:
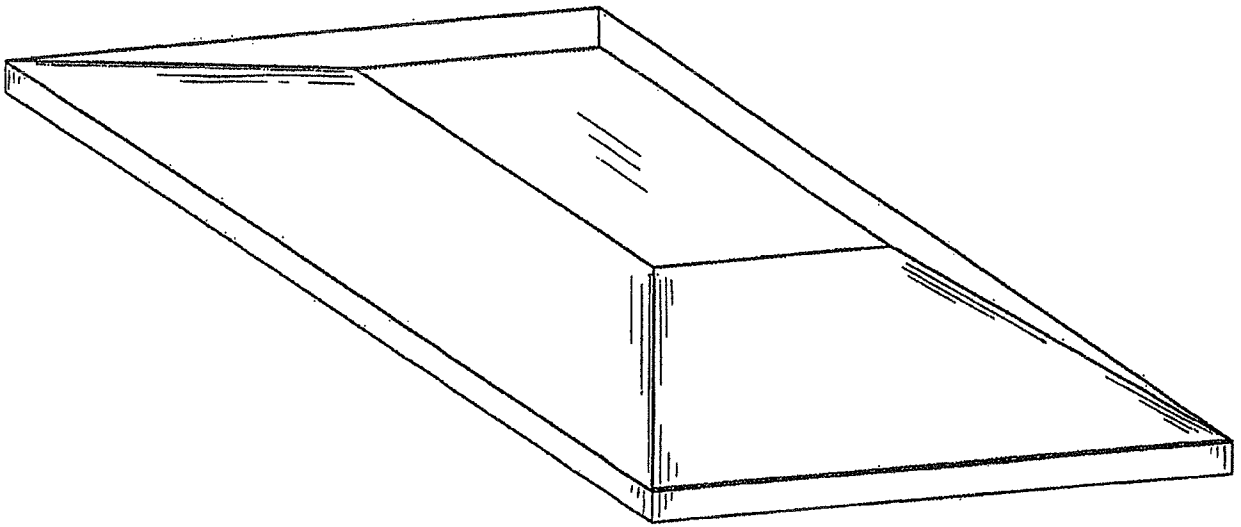
FIG. 36 is a perspective view of a nineteenth modified wall panel according to the present invention.
Figure 37:
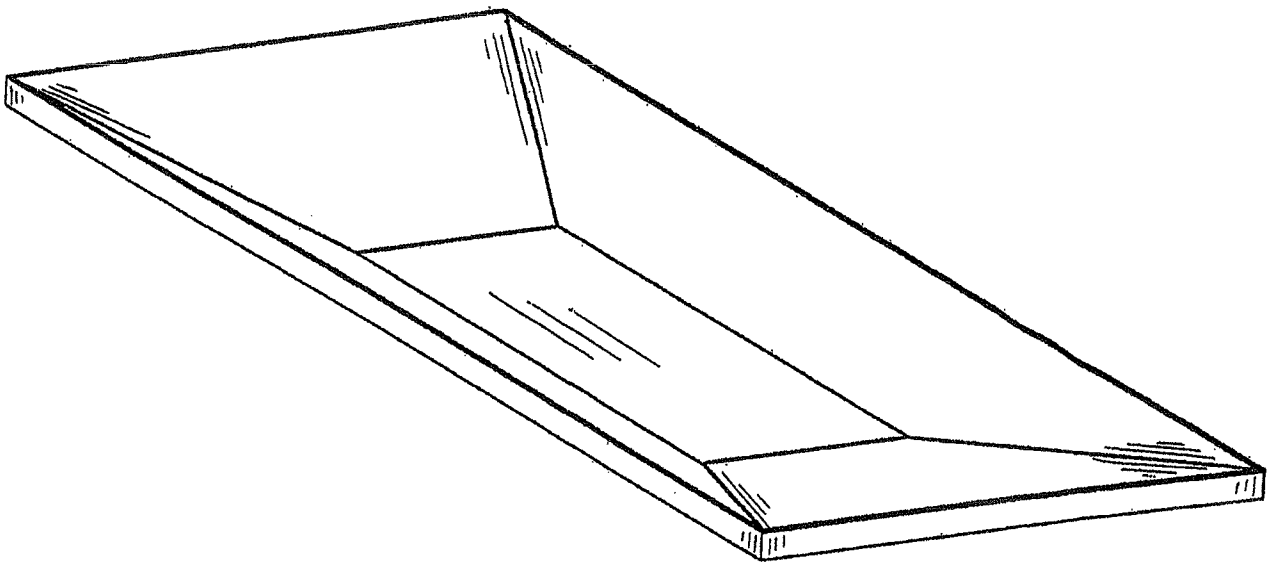
FIG. 37 is a perspective view of a twentieth modified wall panel according to the present invention.

Alternatively, this novel aesthetic appearance can be still further enhanced by providing upper plates 1602 and 1602*a* with their own three-dimensional shape. For example, as shown in FIG. 32, a connecting element 1600*b* is shown in which the upper plate 1602*b* has a bulbous shape. Any other suitable shape can be used for the upper plate, and the shape can be symmetrical or asymmetrical.

Further, the present invention is not limited to trapezoidal surface 562 being connected to single piece element 572. Specifically, any section can be connected to any other section using connecting elements 1600, 1600*a*, 1602 and 1602*a*. For example, triangular surfaces 566 and/or 568 could be connected in this manner to trapezoidal surface 564.

Further, the present invention is not limited to wall panels having the shape as shown in FIGS. 9-13, but any other suitable shape can be provided, for example, the shapes of FIGS. 33-37, and connecting elements 1600, 1600*a*, 1602 and 1602*a* can be used in the same manner.

Figure 39:
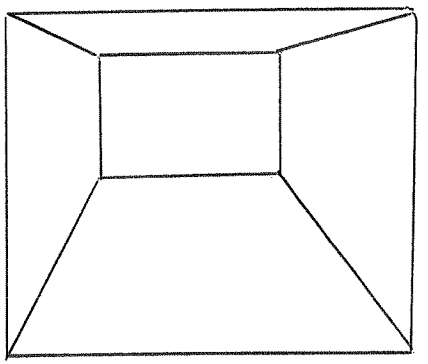
FIG. 39 is a top plan view of a twenty-second modified wall panel according to the present invention.
Figure 41:
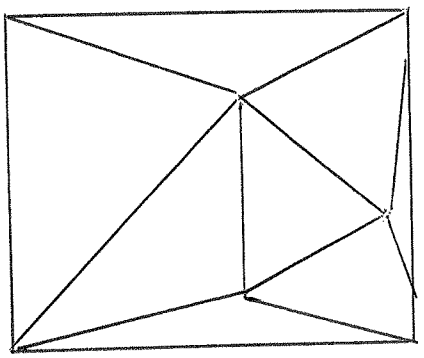
FIG. 41 is a top plan view of a twenty-fourth modified wall panel according to the present invention.
Figure 38:
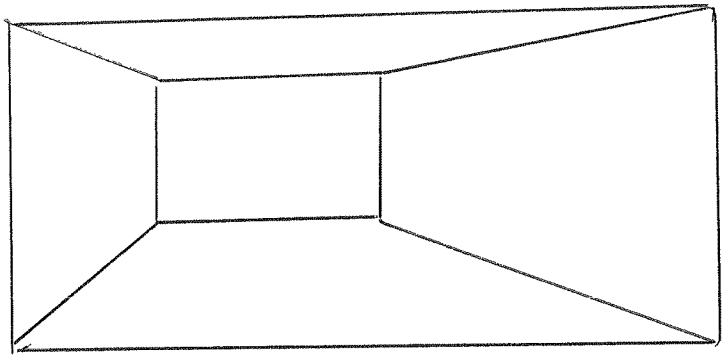
FIG. 38 is a top plan view of a twenty-first modified wall panel according to the present invention.
Figure 40:
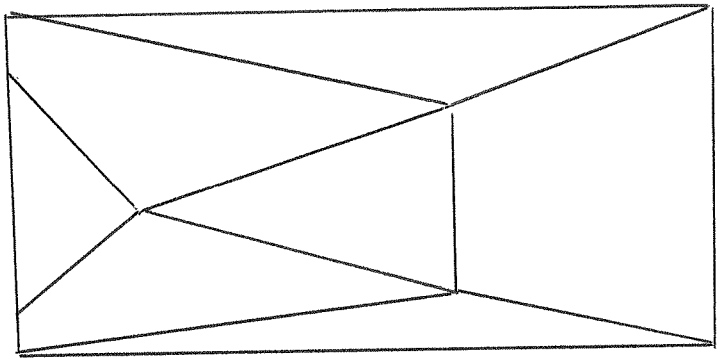
FIG. 40 is a top plan view of a twenty-third modified wall panel according to the present invention.
Figure 42:
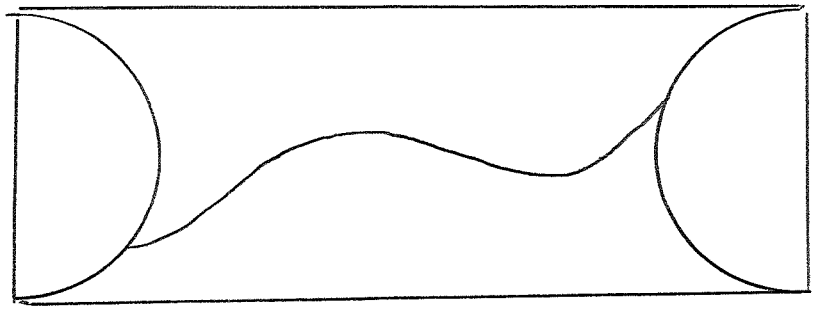
FIG. 42 is a top plan view of a twenty-fifth modified wall panel according to the present invention.
Figure 43:
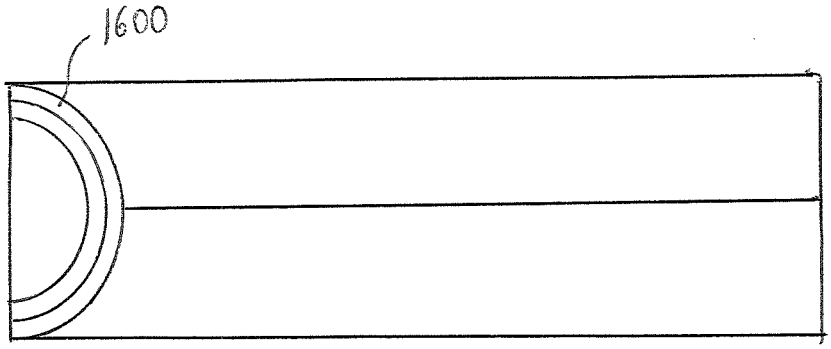
FIG. 43 is a top plan view of a twenty-sixth modified wall panel according to the present invention.
Figure 44:
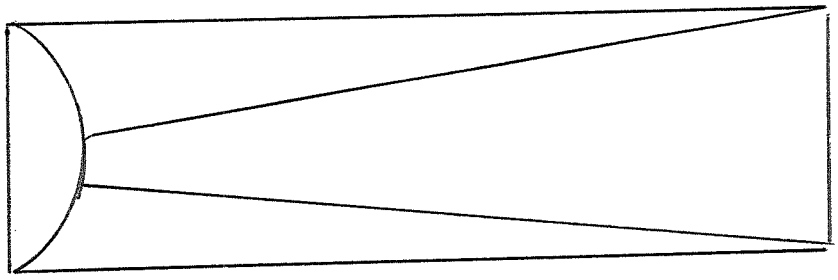
FIG. 44 is a top plan view of a twenty-seventh modified wall panel according to the present invention.

It will be appreciated that each wall panel can be asymmetric, for example, as shown in FIGS. 38 and 39, and can be formed from a large number of sections, as shown in FIGS. 40 and 41. Further, as shown in FIGS. 42-44, the connecting edges of the sections of each wall panel need not be linear, but can be curved.

Figure 50:
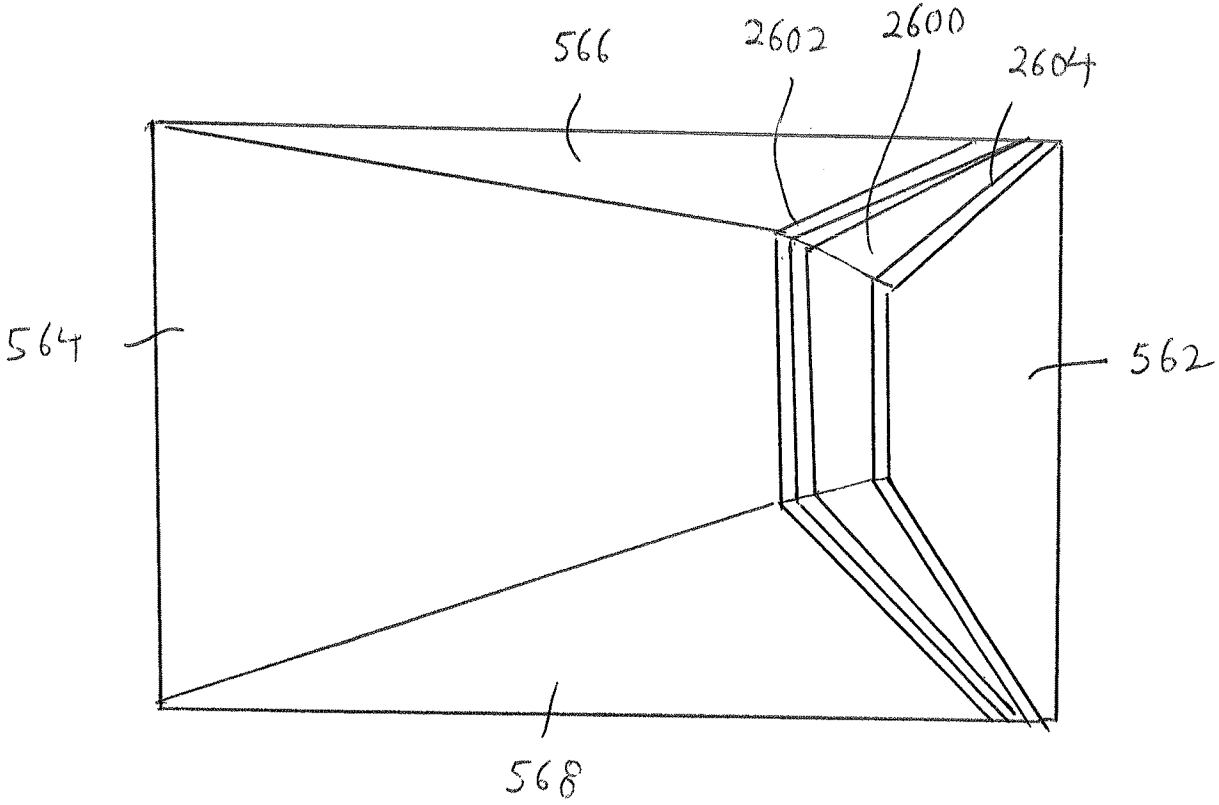
FIG. 50 is a top plan view of a wall panel in which the sections thereof are connected together by any of the modified connecting elements of FIGS. 45-49.

Although connecting elements 1600 and 1602 have been shown to have first and second capture spaces 1608 and 1610 substantially in line with each other, it will be appreciated that they can be offset from each other, as shown by connecting elements 2600 in FIGS. 45-49. Specifically, each connecting element 2600 includes a central web wall 2606 having an upper bifurcated section 2602 connected at one end and extending to one side of central web wall 2606, and defining a first capture space 2608, and a lower bifurcated section 2604 connected at the opposite end and extending to the opposite side of central web wall 2606, and defining a second capture space 2610. As shown in FIGS. 45-49, central web wall 2606 can have various configurations in cross-section, such as a linear shape, a V-shape, or a curved shape. Connecting element 2600 further raises the sections of the wall panel relative to each other to provide an enhanced three-dimensional effect. In addition, central web wall 2606 can reduced down in height from one end to the other end to provide a tapered three-dimensional effect. FIG. 50 shows a wall panel connected with one of the connecting elements 2600 of FIGS. 45-49. It will be appreciated that, as a result of the taper, the section of the wall panel connected to the tapered connecting element 1600 can be inclined.

Further, it will be appreciated that the connecting elements can be used with main wall panel 12 as well as secondary plug wall panels 52.

Figure 57:
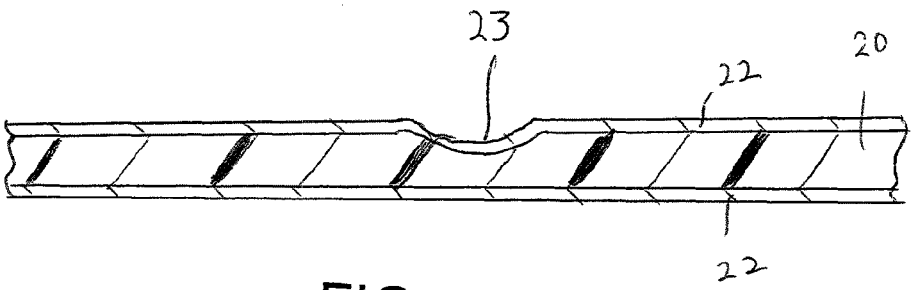
FIG. 57 is a cross-sectional view of the wall panel of FIG. 56, taken along line 57-57 thereof.
Figure 56:
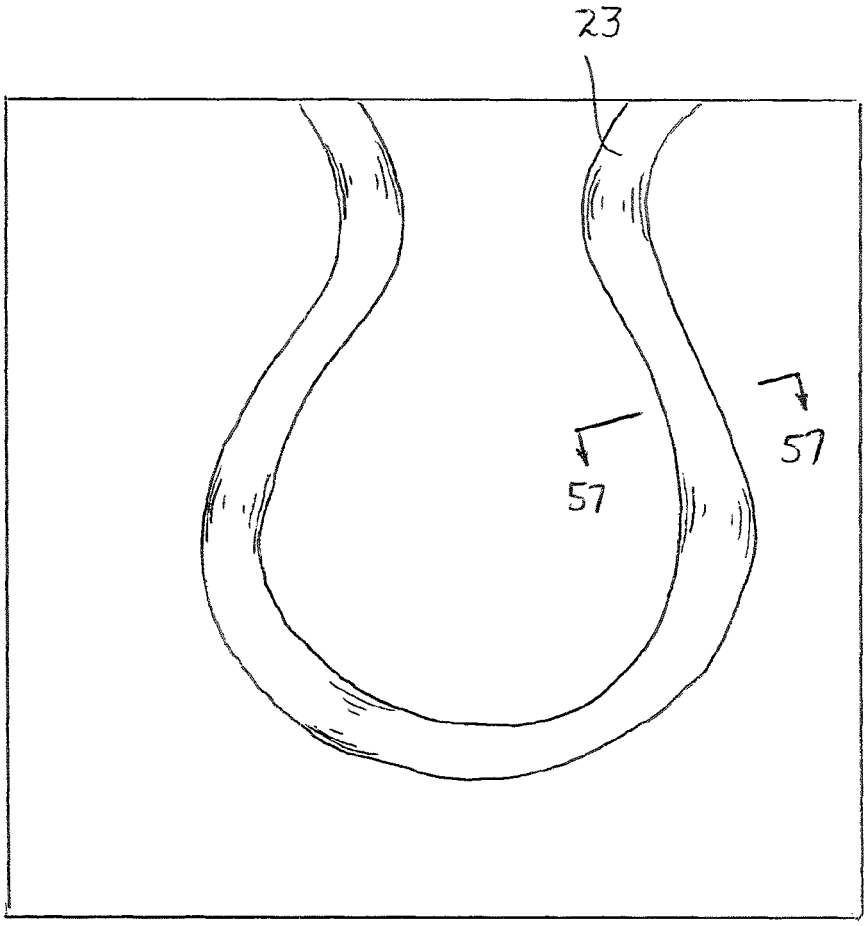
FIG. 56 is a top plan view of a twenty-eighth modified wall panel according to the present invention.

In addition, as discussed above in regard to FIG. 3, primary wall panels 12 are formed preferably by, but not limited to, a polyethylene core 20 with a thin aluminum wall 22 covering opposite sides thereof. In this regard, as shown in FIGS. 56 and 57, the outer thin aluminum wall 22 can be depressed to provide an indentation 23 therein, which can illustrate a viewable design, thereby providing a different three-dimensional effect. Alternatively, the entire panel can be bent to provide the depression.

Further, although all of the above wall panels can be connected to the existing wall structure by bent end sections 18 described above, it will be appreciated that the present invention is not limited thereto, and the wall panels can be connected to an existing wall structure by any suitable means. For example, bent end sections can be provided to be attached to extrusions mounted to an existing wall in accordance with applicant's earlier U.S. Pat. Nos. 7,472,521; 7,621,084; and 8,127,507, the entire disclosures of which are incorporated herein by reference.

It will be appreciated that all of the different shapes of the main wall panel section can be created from a blank by a press.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A dimensional wall panel adapted to be secured to an existing planar wall, in covering relation to the existing planar wall, said wall panel comprising:

a main wall panel including an outer exposed surface on a first outer side of the wall panel, the outer exposed surface having a three-dimensional shape when connected to the existing planar wall, the main wall panel being comprised of a plurality of main wall panel sections extending at different angles relative to each other, at least two adjacent main wall panel sections being discrete sections, with each adjacent main wall panel section including a bent strip for seating flush against the bent strip of the adjacent main wall panel section;

at least one connecting element for connecting together the flush seated bent strips to each other, wherein each bent strip includes a plurality of openings through which the at least one connecting element extends; and at least two bent end sections extending at an angle from different edges of said main wall panel at a second inner side of the main wall panel which is on a direct opposite side from the first outer side of the wall panel, in a direction away from the outer exposed surface, each bent end section adapted for mounting the dimensional wall panel to the existing planar wall in covering relation to the existing planar wall, and all said bent end sections having free ends which are positioned in a common flat plane that is positioned at the second inner side of the wall panel which is on a direct opposite side from the outer exposed surface.

2. A wall panel according to claim 1, wherein each connecting element includes one of the following:

a screw, a rivet, a clamp, and an adhesive.

3. A wall panel according to claim 1, wherein the main wall panel has a shape selected from the following shapes:

a trapezoidal shape in cross-section;

a mushroom shape in cross-section;

a shape in cross-section defined by outwardly inclined surfaces that meet at a central, upper concave surface;

a roof like shape in cross-section;

a shape in cross-section defined by outwardly inclined surfaces that meet at a central, wave-like surface;

a pyramid shape;

trapezoidal side walls connected at shorter sides of each trapezoidal side wall to a rectangular center section; and a plurality of connected arcuate sections.

4. A wall panel according to claim 1, further including at least one opening in the main wall panel.

5. A wall panel according to claim 1, wherein an outer surface of the main wall panel includes at least one depression for creating the three-dimensional shape.

6. A wall panel according to claim 1, wherein the main wall panel extends at least one of:

inwardly of the bent end sections, and outwardly of the bent end sections.

7. A wall panel according to claim 1, further including at least one of the following secured to the dimensional wall panel:

a planter box, at least one lighting element, at least one candle element, at least one picture element and at least one electronic element.

8. A wall panel system for covering an existing planar wall, the wall panel system comprising:

a plurality of adjacent dimensional wall panels adapted to be secured to the existing planar wall in covering relation to the existing planar wall, and at least two of the plurality of said dimensional wall panels each comprising:

a main wall panel including an outer exposed surface on a first outer side of the wall panel, the outer exposed surface having a three-dimensional shape when connected to the existing planar wall, the main wall panel being comprised of a plurality of main wall panel sections extending at different angles relative to each other, at least two adjacent main wall panel sections being discrete sections, with each adjacent main wall panel section including a bent strip for seating flush against the bent strip of the adjacent main wall panel section;

at least one connecting element for connecting together the flush seated bent strips to each other, wherein each bent strip includes a plurality of openings through which the at least one connecting element extends; and at least two bent end sections extending at an angle from different edges of said main wall panel at a second inner side of the main wall panel which is on a direct opposite side from the first outer side of the wall panel, in a direction away from the outer exposed surface, each bent end section adapted for mounting the dimensional wall panel to the existing planar wall in covering relation to the existing planar wall, and all said bent end sections having free ends which are positioned in a common flat plane that is positioned at the second inner side of the wall panel which is on a direct opposite side from the outer exposed surface.

9. A wall panel system according to claim 8, wherein at least two of the plurality of said dimensional wall panels having said three-dimensional shaped main wall panel, are adjacent to each other.

* * * * *